US005495237A

United States Patent [19]

Yuasa et al.

[11] Patent Number: 5,495,237

[45] Date of Patent: Feb. 27, 1996

[54] MEASURING TOOL FOR COLLECTING DOWN HOLE INFORMATION AND METERING VALVE FOR PRODUCING MUD-PULSE USED IN THE SAME

[75] Inventors: Hajime Yuasa; Kazuho Hosono; Hikaru Kamiirisa, all of Akishima; Keijiro Yamamoto, Sagamihara; Hideyuki Miyaji, Atsugi, all of Japan

[73] Assignee: Akishima Laboratories (Mitsui Zosen) Inc., Tokyo, Japan

[21] Appl. No.: 162,523

[22] Filed: Dec. 6, 1993

[30] Foreign Application Priority Data

Dec. 7, 1992 [JP] Japan ..... 4-327012
Dec. 7, 1992 [JP] Japan ..... 4-327056

[51] Int. Cl.[6] ..... G01V 1/00

[52] U.S. Cl. ..... 340/854.6; 340/853.1; 340/854.8; 175/50

[58] Field of Search ..... 340/853.1, 853.3, 340/853.6, 854.6, 854.8; 166/250; 175/40, 50; 367/25

[56] References Cited

U.S. PATENT DOCUMENTS

| | | | |
|---|---|---|---|
| 3,853,185 | 12/1974 | Dahl et al. | 175/45 |
| 3,918,537 | 11/1975 | Heilhecker | 175/320 |
| 4,785,247 | 11/1988 | Meador et al. | 324/338 |
| 5,064,006 | 11/1991 | Waters et al. | 175/45 |
| 5,160,925 | 11/1992 | Dailey et al. | 340/853.3 |
| 5,163,521 | 11/1992 | Pustanyk et al. | 175/40 |
| 5,220,963 | 6/1993 | Patton | 175/24 |
| 5,295,548 | 3/1994 | Yuasa et al. | 175/40 |
| 5,305,830 | 4/1994 | Wittrisch | 166/250 |

FOREIGN PATENT DOCUMENTS

| | | |
|---|---|---|
| 0539240 | 4/1993 | European Pat. Off. . |
| 0552087 | 7/1993 | European Pat. Off. . |
| WO93/05271 | 3/1993 | WIPO . |

*Primary Examiner*—Ian J. Lobo
*Attorney, Agent, or Firm*—Lowe, Price, LeBlanc & Becker

[57] ABSTRACT

A measuring tool for collecting down hole information, which essentially has a sensor sub including plural data collecting sensors secured at a forward portion of a drilling pipe and a sonde movable in the drilling pipe. Both the sensor sub and sonde employ a set of loop antennas to effect radiocommunication between them to thereby certainly send data detected by means of the sensors to the sonde.

8 Claims, 21 Drawing Sheets

MEASURING TOOL FOR COLLECTING DOWN HOLE INFORMATION AND METERING VALVE FOR PRODUCING MUD-PULSE USED IN THE SAME

BACKGROUND OF THE INVENTION

1. Field of the Invention

This invention is broadly concerned with a measuring tool for collecting down hole information and a metering valve for producing a so-called mud-pulse used in the measuring tool and intended particularly to be used in a technology to collect data at a down hole of a vertical/inclined shaft which is dug to construct petroleum wells, geothermal wells or natural gas wells, or for seismic observation or geological survey.

2. Description of the Related Art

Several types of vertical shaft have previously been dug underground to construct petroleum wells, geothermal wells or natural gas wells, or for seismic observation or geological survey.

These shafts are generally made by rotation of a long and narrow drilling pipe having a drilling bit at its forward end. The drilling pipe is adapted to flow a mud-flow thereinside.

The mud-flow is transferred through the interior of the drilling pipe from ground level and then fed out at the lower most portion of the drilling pipe (i.e., the drilling bit), prior to returning to the earth's surface through a space between the drilling pipe and the vertical shaft. Such circulation of the mudflow can move and discharge to the ground level unnecessary articles from down hole, such as stones, rocks and sediment by means of water flow. When the shaft depth is in the range of 5,000 meters, the mud-flow carried from the down hole is generally high in temperature due to geothermal heat and water pressure.

It is noted that information, about load to the bit and conditions such as pressure, temperature, bit road and bit torque and temperature at the down hole, should be continuously and closely observed throughout the drilling operation. Accordingly, a measuring tool which can collect various information at the down hole and transmit same to ground level is known.

There are two known types of conventional down hole information collecting devices, one being a permanent-type which can be fixed relatively near the drilling bit until the drilling operation is completed, the other being of a retrievable-type which can be retrieved to ground level from the down hole when necessary, but only a main part of the other down hole information collecting device can be retrieved.

The permanent-type down hole information collecting device is so arranged that plural sensors and a main part thereof are associated into a bitsub as an auxiliary pipe to connect the drilling bit with the long drilling pipe.

The retrievable-type down hole information collecting device comprises a sonde containing therein the plural sensors and the main part all together. This sonde is provided with the bitsub separately so that it can be withdrawn to ground level by using wire rope.

As each sensor is electrically and directly related with the drilling bit in the permanent-type down hole information collecting device, it will be observed that such useful data for the drilling bit as torque and load can be measured comfortably, but the device can not be withdrawn to the ground even when a temperature at the down hole will become extremely high, so that the device will be badly influenced and broken down sometimes.

While the retrievable-type down hole information collecting device will not be damaged by unforeseen heat, pressure and the like, since the sonde can be withdrawn from the down hole to the ground level, but a preferable electrical connection between the sonde and the sensors installed in the drilling bit may not be ensured whereat information around the drilling bit can not be collected reliably.

The such down hole information collecting device is generally provided with a mud-pulse generating device to transmit down hole information to the ground level. The mud-pulse generating device has a function to send information to the ground by means of pressurized pulse which propagates the information through the mud-flow fed into the drilling pipe.

The above-mentioned device employs a metering valve which can quickly wring a flow rate of the mud-flow so as to generate the pressurized pulse. One of known typical metering valve employs a mechanical type switching valve where a port passing therethrough the mud-flow is opened and shut repeatedly by using a plug.

However, it has been noted among persons in the art using the mentioned conventional mechanical type metering valve that relatively large port and corresponding plug were necessary to keep enough flow rate of the mud-flow, which naturally caused uncomfortable transmitting of the pressurized pulse and waste of electrical power when operating the metering valve, because of a heavy weight of the plug and a resistance raised by the mud-flow.

A slight opening immediately before and after a complete closing of the associated port and plug may cause a high speed flow of the mud-flow to thereby wear respective surfaces of the associated members. Furthermore, the presence of some articles containing the mud-flow between the port and the plug may cause severe problems by unforeseen shock and vibration of the drilling bit.

The present invention aims to provide a measuring tool which can collect information near the drilling bit in a vertical/inclined shaft and which is so arranged that a main part thereof can be retrieved to the ground if necessary.

Another object of the present invention is to provide a metering valve which can generate pressurized pulse securing a high transmitting rate with a little electrical power and which can produce mud-pulse in the tool with no troubles.

SUMMARY OF THE INVENTION

A measuring tool for collecting down hole information in a shaft according to the present invention includes: a sensor sub having, at a forward portion of a drilling pipe, plural sensors to collect data there, a sonde movable in an upper and lower direction in the drilling pipe, a signal sending portion at said sensor sub, a signal receiving portion at said sonde; and a radiocommunication means to effect radiocommunication by means of an electromagnetic wave through the signal sending portion and said signal receiving portion.

The signal sending and receiving portions consist of loop antenna. The loop antenna may be another directional one which sends electromagnetic wave along a central axis of the drilling pipe.

At least one of the sensor sub and the sonde may be provided with a turbine generator. Otherwise, the sensor sub has therein a rotatable turbine and the sonde has a generator which is equipped with a propeller shaft interconnecting with the turbine in the sensor sub.

The sonde may include a floating device to be risen by means of buoyancy of a chamber in which a gas is chemically generated in a gas generator.

The chemical reaction in the gas generator is effected by a sodium bicarbonate and a acid.

The sonde may include a criticalness suspecting means which compares a prepared standard value with a measured value of the sensors in the sensor sub and issues a signal when the measured value is beyond the standard value.

The sonde is integrated with a centraliser, so that the central axis of the sonde is axially aligned with the central axis of the drilling pipe.

The centraliser consists of plural arch-shaped blade springs along said sonde.

A metering valve for producing mud-pulse in a mud-flow in the measuring tool for collecting down hole information in a shaft, consists of: an open/straight passage for straight stream of the mud-flow; a detour/interference passage for falling out of the straight stream of the mud-flow; and a changeover means for shifting a main stream of the mud-flow from one of the open/straight passage and the detour/interference passage to the other.

The detour/interference passage has an inlet branched from the open/straight passage and an outlet opening to the open/straight passage.

The changeover means projects to and is buried reciprocally from a branch portion of the open/straight passage and the detour/interference passage.

The changeover means is an inclination rod. The changeover means may be capable of rotating round an axis parallel to a central axis of the open/straight passage and has a straight hole axially aligned with the open/straight passage and a backflow path branched from the straight hole.

The changeover means can be installed in a wall of the sonde. The changeover means may consist of an orifice blowing the mud-flow, a pair of control ports confronting each other behind the orifice, conduit pipes respectively connected with the control ports and valves provided on a way of the respective conduit pipes.

The changeover means consists of rod springs to which elements of the changeover means are attached and a partially tapered shaft which moves forward and backward reciprocally relatively with the rod springs, so that each element of the changeover means correspondingly projects and buries.

The changeover means may consist of a changeover element, an arm which is integrated with and swings the changeover element, a driving shaft, a cam mechanism to convert a rotation of the driving shaft to a swing of the arm and a driving means to rotate the driving shaft.

The changeover element of the changeover means is moved by a driving mechanism which has a solenoid.

The detour/interference passage has a whirl generating device. The detour/interference passage is formed by spiral grooves. The detour/interference passage may has at least one vane so that the mud-flow fed thereunto become whirl. The vane is plural and of which each crosses over and helically between the respective edges of the spiral lines. The detour/interference passage may has a straight introductory path.

DETAILED DESCRIPTION OF THE PREFERRED EMBODIMENT(S)

The preferred embodiment of the present invention will now be described with reference to the attached drawings.

Figure 1:
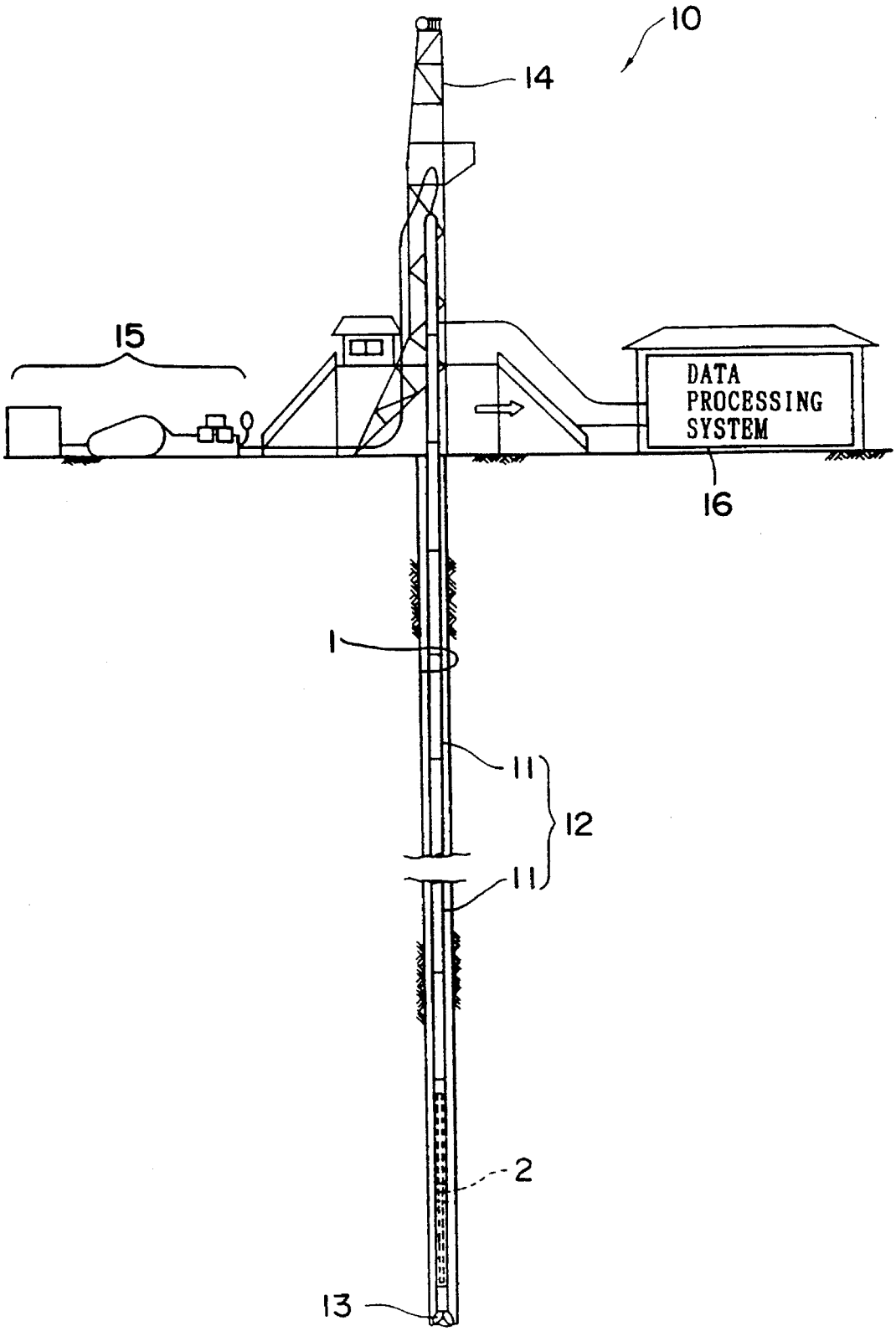
FIG. 1 is a diagrammatic view indicating the appearance of the overall composition of the first embodiment of the present invention.

FIG. 1 shows a drilling tool 10 according to the first embodiment of the present invention which comprises a drilling pipe 12 consisting of plural steel pipes 11 lengthwisely. The drilling pipe 12 has at its forward end a drilling bit 13 of which rotation made a shaft 1.

A measuring tool 2 for collecting down hole information according to the present invention is oriented at a forward end of the drilling pipe 12.

On the ground, associated facilities such as a mud-flow force feed apparatus 15 and a data processing system 16 are located around a turret 14 for drilling.

The mud-flow force feed apparatus 15 is provided to forcibly feed the mud-flow into the inside of the drilling pipe 12 from the ground level, by which flow unnecessary articles such as stones, rocks and sediment picked by the drilling bit 13 are discharged to the ground. The fed mud-flow may be useful to cool down the measuring tool 2 when heated hardly by terrestrial heat.

The data processing system 16 is preferably a computer capable of indicating data every moment collected by the measuring tool 2 and also successively analyzing the collected data. This data processing system 16 also includes sensors not shown, by which a mud-pulse as a pressure wave originally sent from the measuring tool 2 and transmitted through the mud-flow can be received.

Figure 2:
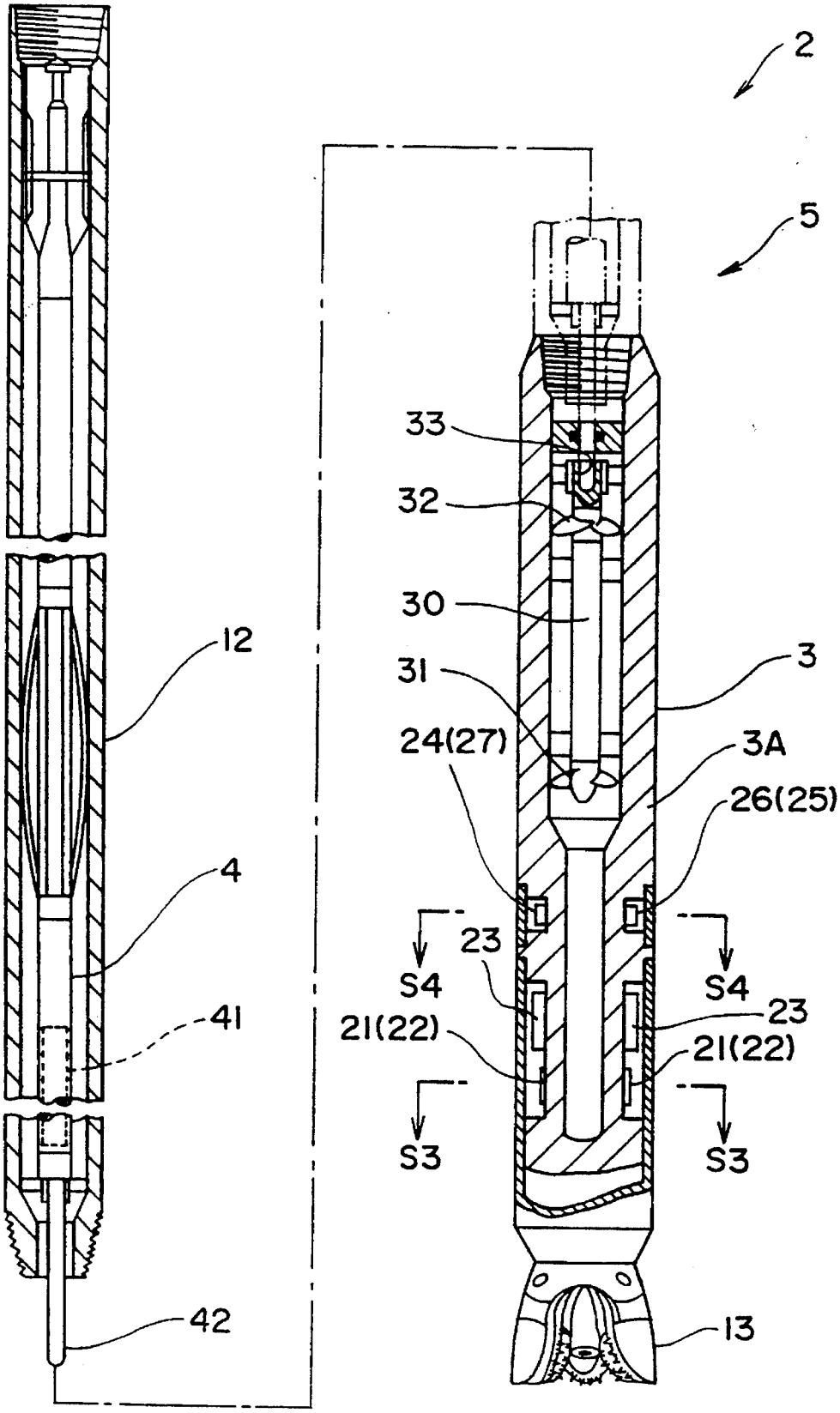
FIG. 2 is an enlarged sectional view showing a sensorsub and a sonde in the first embodiment.

FIG. 2 shows the measuring tool 2 in an enlarged state. The measuring tool 2 is defined by a sensorsub 3 which is oriented between the drilling bit 13 and the drilling pipe 12 and a sonde 4 which can be moved smoothly in the drilling pipe 12, whereby the tool 2 is called "Retrievable System".

Figure 3:
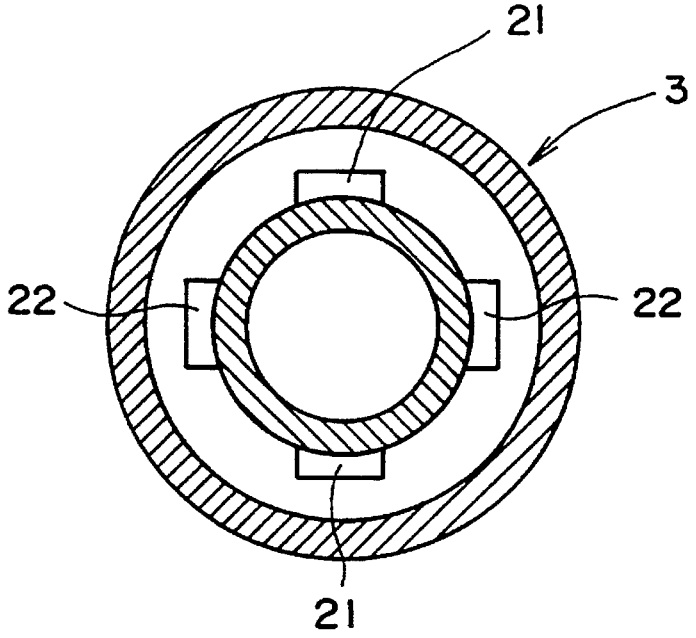
FIG. 3 is an enlarged sectional view taken along the S3—S3 line in FIG. 2.
Figure 4:
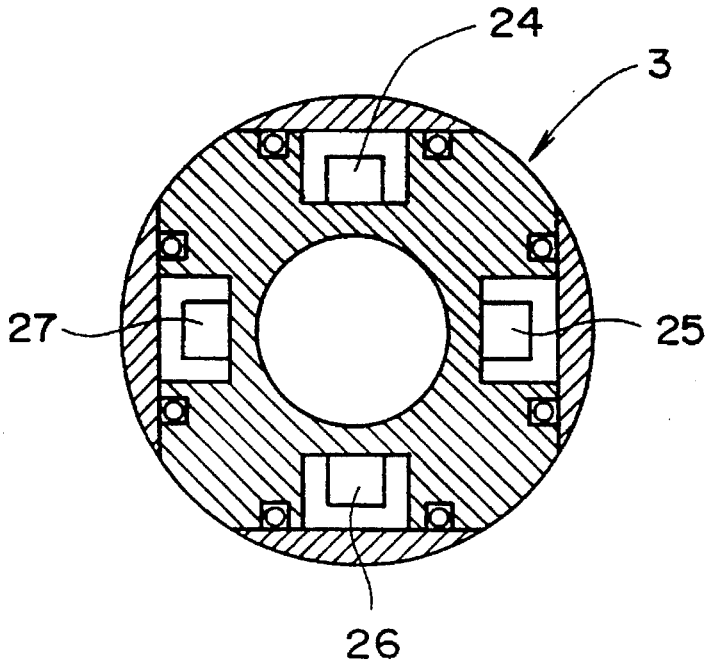
FIG. 4 is an enlarged sectional view taken along the S4—S4 line in FIG. 2.

The sensorsub 3 is generally formed into a cylindrical shape with a thick wall 3A. At an inside of the thick wall 3A of the sensorsub 3 and near the drilling bit 13, bit load sensors 21 and bit torque sensors 22 along with respective amplifiers. 23 are preferably arranged as shown in FIG. 3.

Incidentally, the bit load sensors 21 and the bit torque sensors 22 are alternately disposed at an interval of 90 degrees on a circle round a central axis of the sensorsub 3.

The wall 3A also contains, at an upper part of the amplifiers 23 in FIG. 2, an internal temperature sensor 24 to measure an inside temperature of the sensorsub 3, an external temperature sensor 25 to measure a temperature in the shaft 1, an external pressure sensor 26 to sense a pressure in the shaft 1 and a processing unit 27 to digitize data obtained in the mentioned sensors 24 through 26.

The sensorsub 3 also has therein a generator 30 having a column shape. It will be seen in FIG. 2 that the generator 30 has a turbine 31 at its lower end, by which rotation due to the mud-flow flow a necessary electrical power can be generated.

The generator 30 is also provided, at its upper end, with another turbine 32 in a state to be rotated freely by the mudflow. This turbine 32 has at a top portion thereof a hole 33 with a key.

The sonde 4 is formed into a long and narrow rod. The sonde 4 has at its lower portion as depicted in FIG. 2 a generator 41 of its own, which is independent from the generator 30 provided in the sensorsub 3. The generator 41 is provided with a rotatable propeller shaft 42 extending to the turbine 32.

At a forward end of the propeller shaft 42 there is provided a keyway relative to the key in the hole 33 of the turbine 32, so that when intermeshing each other, the mud-flow flow can effect a rotation of the turbine 32 to thereby generate a sufficient electrical power in the generator 41.

Figure 5:
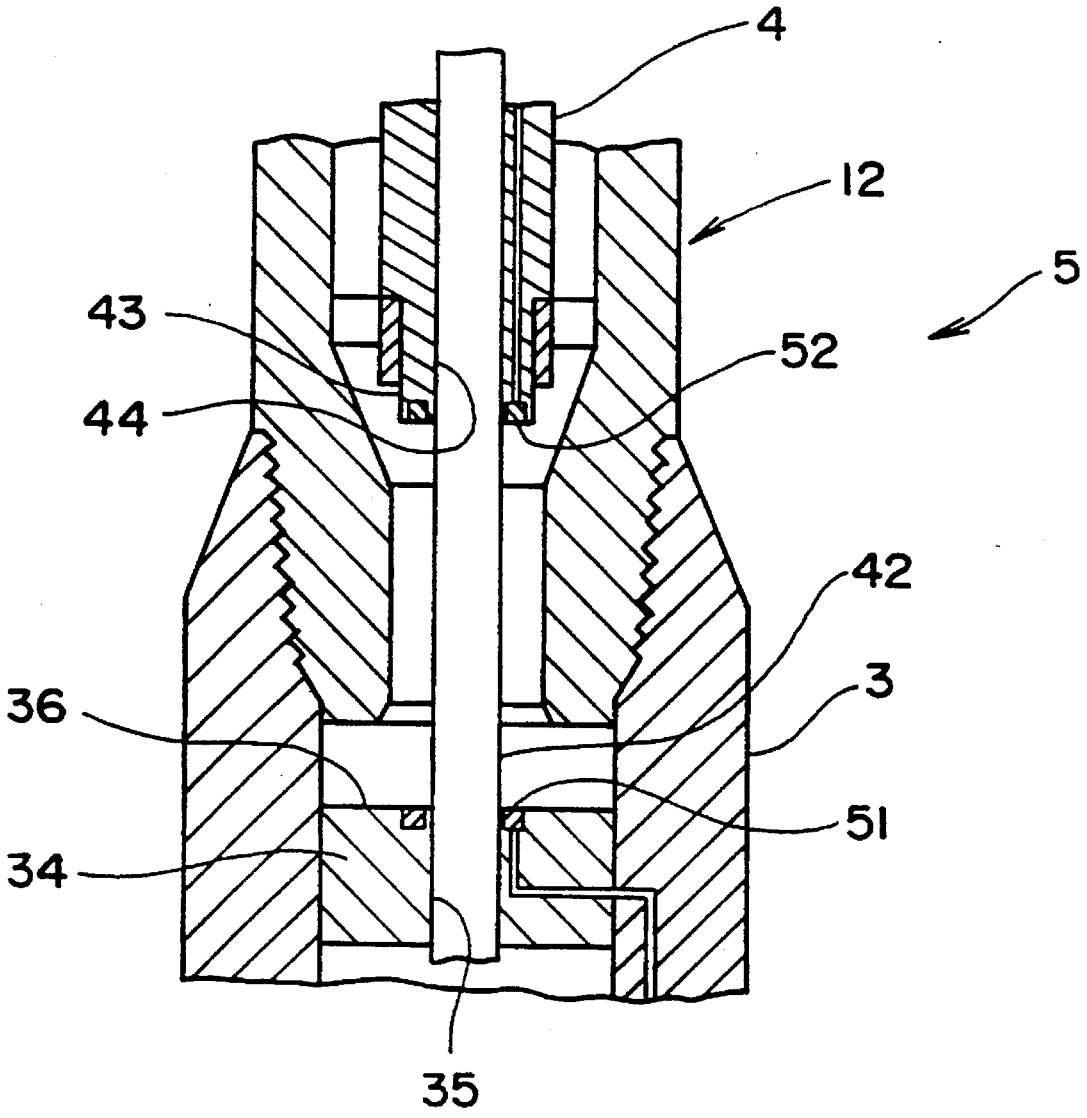
FIG. 5 is an enlarged sectional view showing a loop antenna in the first embodiment.

At a portion illustrated at 5 in FIG. 5 where the sensorsub 3 is connected with the sonde 4, there are a pair of antennas 51 and 52 which are disposed to confront each other and shaped into a loop to receive thereunto the propeller shaft 42 of the sonde 4.

The loop antenna 51 is integrated with a baffle plate 34 across the circular wall 3A of the sensorsub 3. The baffle plate 34 has at its center portion a hole 35 to receive therein the propeller shaft 42 of the sonde 4.

While the loop antenna 52 is attached to a forward end portion 43 of the sonde 4 near the sensorsub 3. The forward end portion 4 has a hole 44 to keep the propeller shaft 42 rotatable.

It will be apparent that both central axes of the loop antennas 51 and 52 will be axially aligned with each other, when the propeller shaft 42 of the sonde 4 will be inserted into the hole 35 of the baffle plate 34.

The loop antennas 51, 52 are made round into a circle with a conductive material so that the data processed in the processing unit 27 is sent from the loop antenna 51 toward the sonde 4 and the thus sent data will be received at the loop antenna 52.

Figure 6:
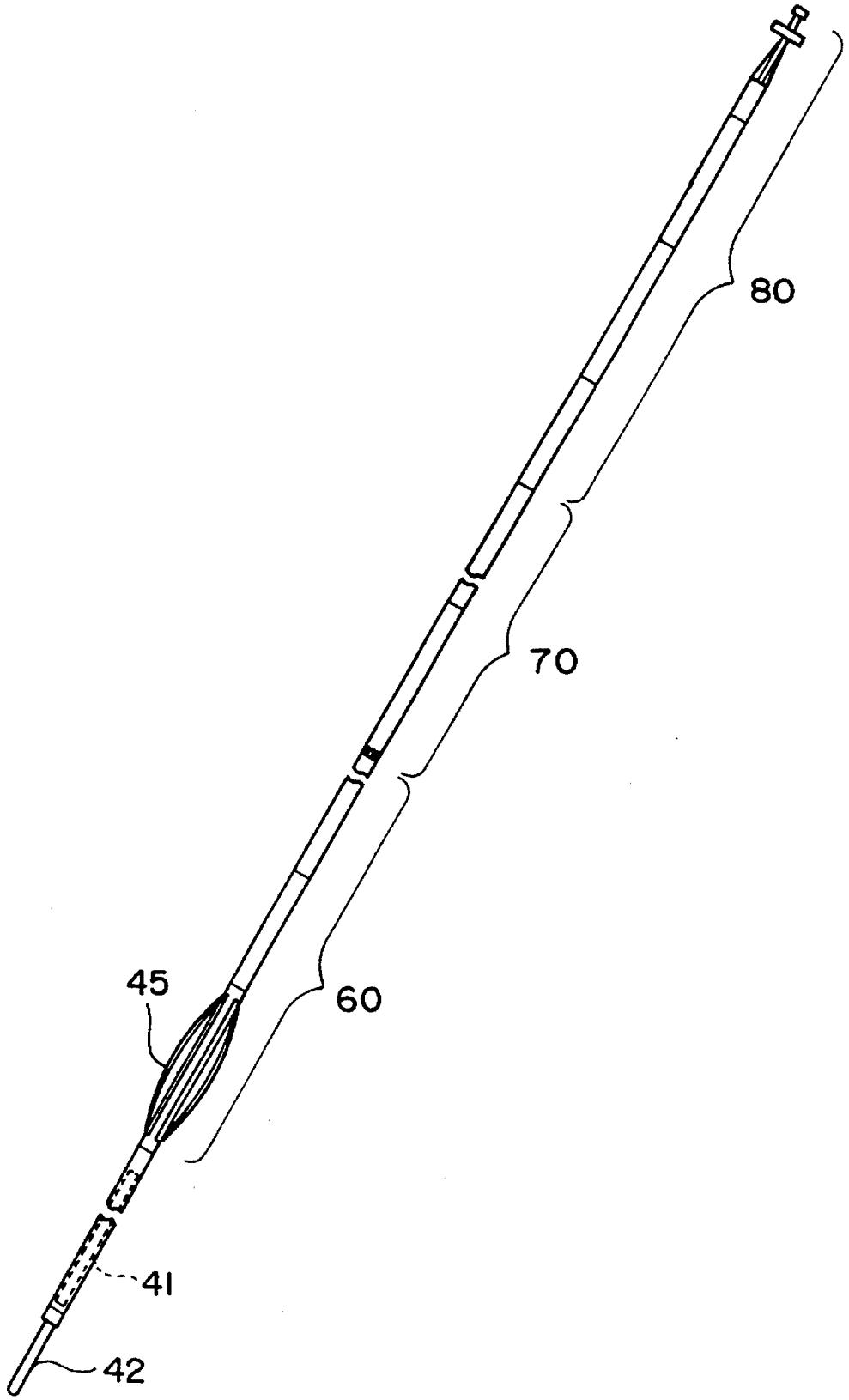
FIG. 6 is a side elevational view showing a whole composition of the sonde in the first embodiment.

FIG. 6 is a front view indicating the overall composition of the sonde 4.

The sonde 4 is defined by an arch-shaped centraliser 45 bulging in the radial direction, an electronic device receiving portion 60 which process measured data, a floating device 70 to rise the sonde from the down hole to the ground level, and a mud pulse generating device 80 which changes obtained data to pressure pulse and sends the pressure pulse to the ground through the mud-flow in the drilling pipe 12.

The centraliser 45 is specially shaped by plural arch-shaped blade springs so that the central axis of the sonde 4 can be axially aligned with that of the drilling pipe 2. When the sonde 4 is thrown into the drilling pipe 12 from the ground level, the propeller shaft 42 can be smoothly coupled into the turbine 32 in the sensorsub 3 by means of the mentioned centraliser 45.

The electronic devices receiving portion 60 is a heat insulating closed type housing which is adapted to receive therein electrical elements like high-temperature IC so that a preferable operation of the electrical elements can be kept even in a high temperature and a high pressure mud-flow.

Figure 7:
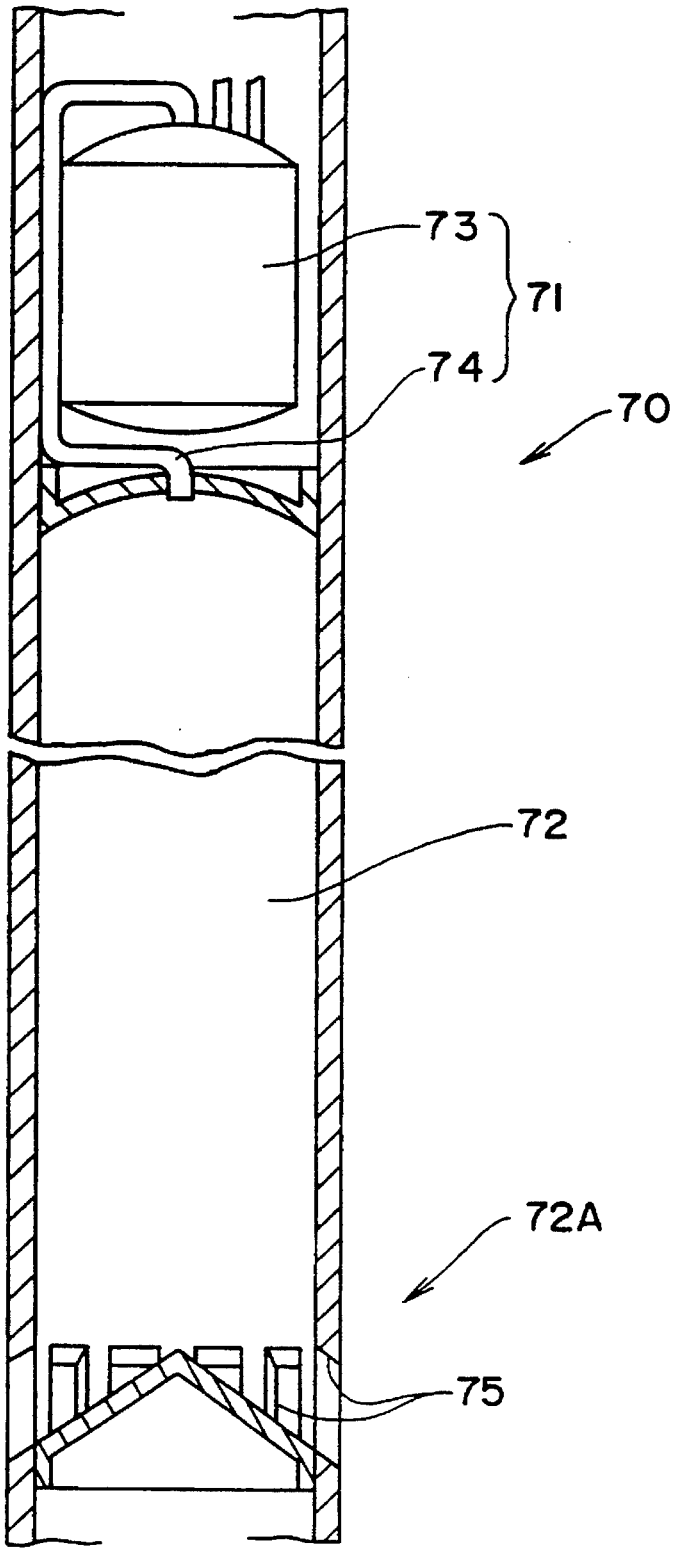
FIG. 7 is an enlarged sectional view showing a levitation device used in the first embodiment.

The floating device 70 consists essentially of a gas generator 71 to produce a high pressure gas by a chemical reaction and a chamber 72 to store the gas from the gas generator 71, as shown in FIG. 7.

The gas generator 71 can chemically react plural materials like a sodium bicarbonate and an acid in a case 73 and feed the pressure gas chemically obtained into the chamber 72 via a pipe 74.

The chamber 72 is a case utilizing a vacant inside space of the sonde 4 and has at its lower end a discharge port 75 for the mud-flow.

When collecting data, the chamber 72 is filled up with the mud-flow so that the sonde 4 can be kept in the mud-flow. Upon a necessity to take the sonde 4 out from the down hole of the shaft 1, the gas produced in the gas generator 71 is fed into the chamber 72 whereby the sonde 4 can rise to the ground level.

Figure 8:
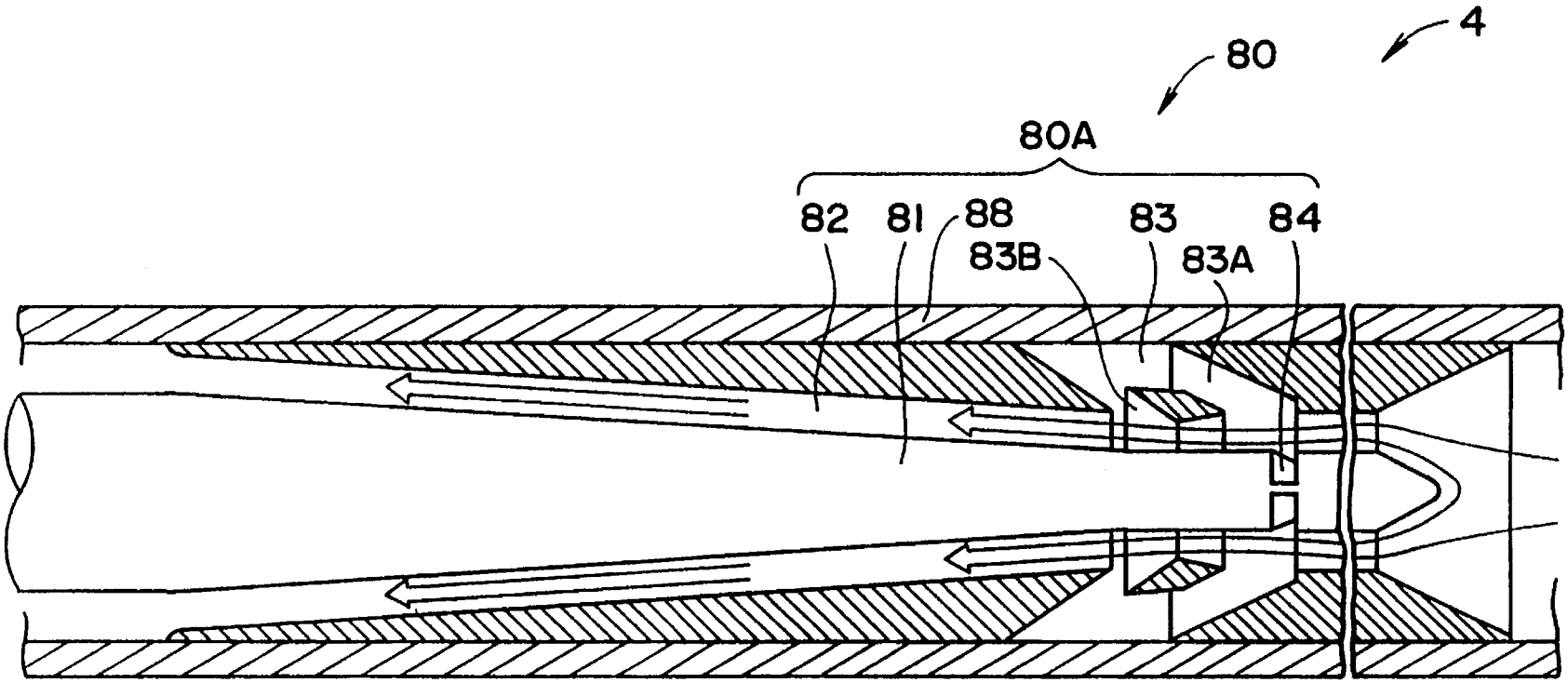
FIG. 8 is an enlarged sectional view showing a mud-pulse generating system in an opening state according to the first embodiment.
Figure 9:
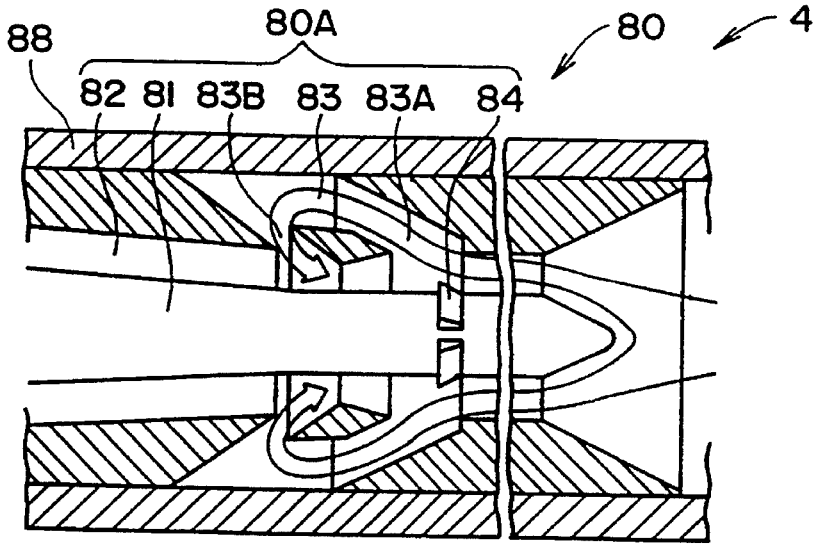
FIG. 9 is an enlarged sectional view showing the mud-pulse generating system in a closing state opposed to that in FIG. 8.

The mud pulse generating device 80 comprises a metering valve 80A as shown in FIGS. 8 and 9. The metering valve 80A can be operated by a column-shaped driving device 81 which is installed in the sonde 4.

Figure 10:
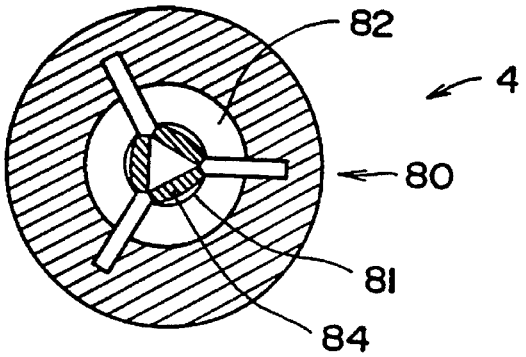
FIG. 10 is a vertical sectional view of FIG. 8.
Figure 11:
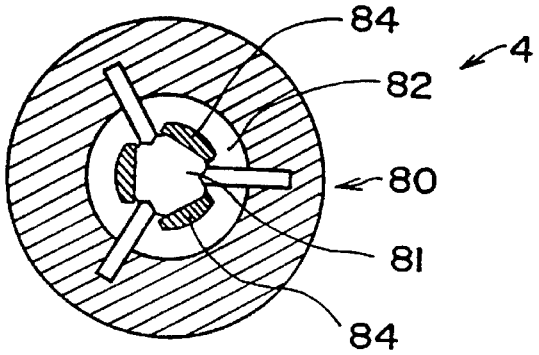
FIG. 11 is a vertical sectional view of FIG. 9.

There are provided a straight passage 82 as an opened path and a detour passage 83 as an interference passage between the driving device 81 and a housing 88 of the sonde 4. It will be apparent that the housing 88 has an inlet (not shown) for an inflow of the mud-flow from the outside and an outlet (not shown) for an outflow of the same from the passages 82 and 83 to the outside of the sonde 4. The driving device 81 has at the forward end a changeover element 84 of which each element is reciprocally movable and has a wedge shape, as can be seen in FIGS. 10 and 11.

The straight passage 82 is formed into a straight shape not to cause flow resistance of the mud-flow. A sectional shape of the detour passage 83 is as shown in FIGS. 9 to 11. An inlet 83A and an outlet 83B of the detour passage 83 are opened toward the upstream of the mud-flow.

The radially reciprocal movement of the changeover element 84 by means of the driving device 81 can shift the main mud-flow stream from one of the straight passage 82 and the detour passage 83 to the other.

More specifically, when the changeover element 84 is buried in the driving device 81, the most of the mud-flow fed into the mud pulse generating device 80 is straightly guided into the straight passage 82 whereat, as shown in FIG. 8, the mud-flow flows straight with a low resistance in the metering valve 80A.

Meanwhile, when the changeover element 84 projects from the driving device 81, the main mud-flow stream is shifted to the inlet 83A of the detour passage 83 because of an inclined surface of the changeover element 84. The guided mud-flow in the detour passage 83 flows upstream from the outlet 83B so as to put out of the stream line of the mud-flow fed into the mud pulse generating device 80, which is depicted in FIG. 9. This upstream flow causes more resistance than in a case that the changeover element 84 is buried.

Figure 12:
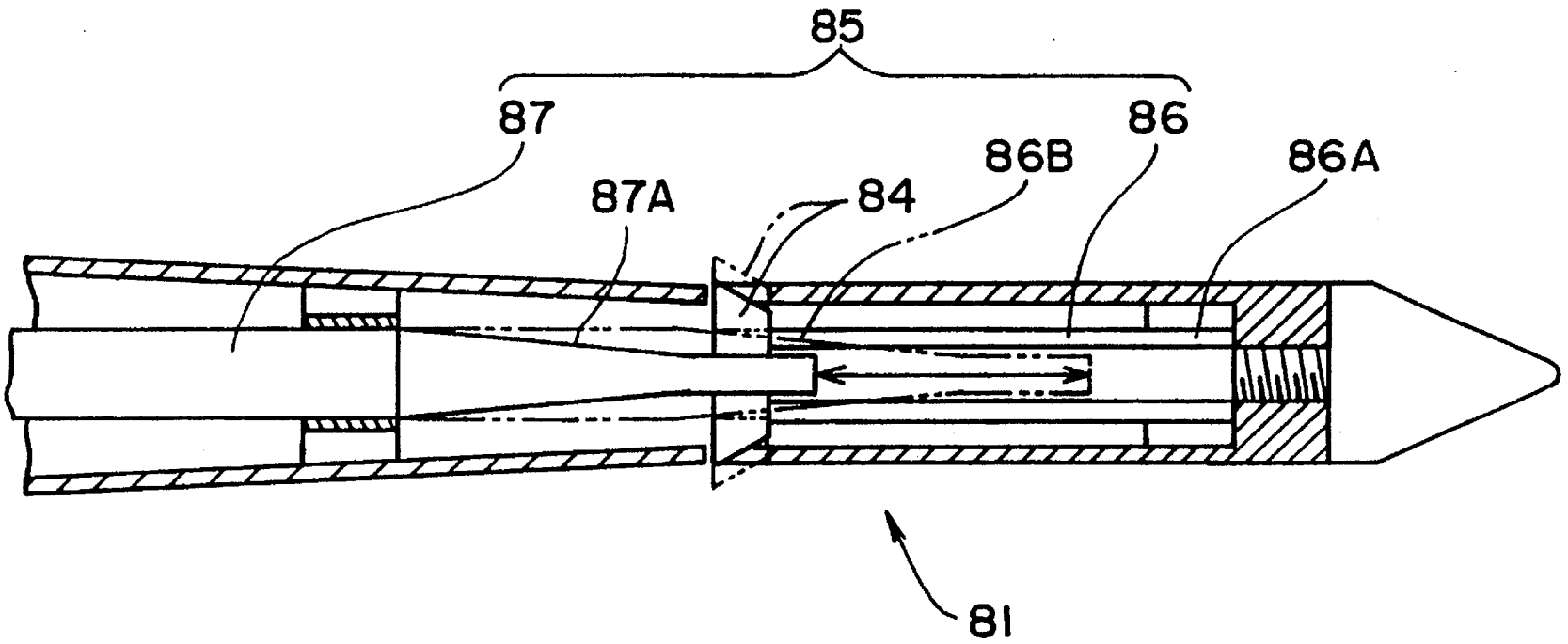
FIG. 12 is an enlarged sectional view showing a driving system of the mud-pulse generating device in FIG. 8.

The details of the driving device 81 is depicted in FIG. 12, wherein a driving mechanism 85 moving the above-explained changeover element 84 is provided.

The driving mechanism 85 consists of a long rod-like spring 86 along the longitudinal direction of the driving device 81 and a shaft 87 movable along the same.

The shaft 87 has a conic surface 87A at its forward portion and is provided with, at its backward portion, a preferable driving means such as a solenoid or a motor to be moved in a longitudinal direction.

The spring 86 is adapted so that its one end portion 86A is secured to an inside wall of the driving device 81 and the other end 86B is related to the changeover element 84 to reciprocally move in the radial direction of the driving device 81.

The each element of the changeover element 84 is permanently urged to the forward portion of the shaft 87 by the spring 86.

Therefore, an advance movement of the shaft 87 effects a reciprocal projection of the changeover element 84 because of the conic surface 87A and while a return movement of the same buries the changeover element 84. Incidentally, such a reciprocal movement of the changeover element 84 by means of the shaft 87 is referred to as the driving mechanism 85.

Figure 13:
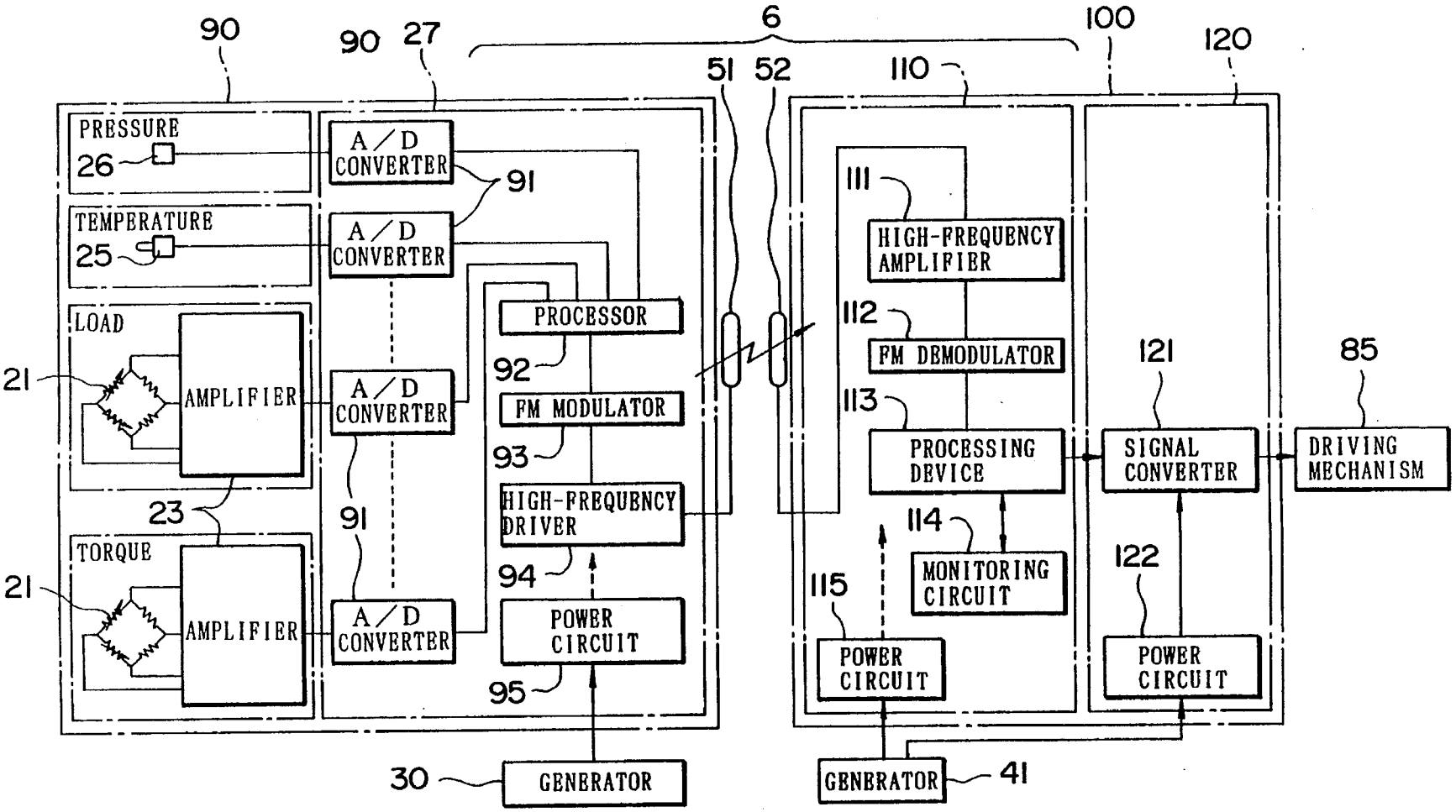
FIG. 13 is a block diagram showing an electric circuit according to the first embodiment.

FIG. 13 shows an electric circuit 6 for the measuring tool 2 for collecting down hole information according to the present invention.

The electric circuit 6 comprises a sensing processor 90 provided in the sensorsub 3 and a sending processor 100 provided in the sonde 4.

The sensing processor 90 essentially includes the above mentioned sensors 21, 22, exclusive amplifiers 23 for each sensor and a processing unit 27 to change plural analog signals measured in the sensors 21, 22 into series digital signals.

The processing unit 27 consists of plural A/D converters 91 to change analog signals measured by the sensors 21, 22 into digital signals, a processor 92 to regulate parallel digital signals sent from the A/D converters 91 to a series digital signal, a FM modulator 93 to modulate the series digital signal made in the processor 92, and a high-frequency driver 94 to generate carry waves for modulation. Incidentally, the FM modulator 93 and the high-frequency driver 94 are referred to as a radiocommunication means in the sensorsub 3.

The processing unit 27 is adapted to send, from the antenna 51, the series digital signal measured by the sensors 21, 22 as a high-frequency signal.

The processing unit 27 is equipped with a power circuit 95 to constantly supply DC voltage to the exclusive amplifiers 23 for the sensors 21, 22 and the like, an electric power in the power circuit 95 being supplied from the generator 30.

The sending processor 100 comprises a signal processing unit 110 demodulating the high-frequency signal which is sent from the processing unit 27 and caught at the antenna 52 and a control unit 120 controlling the driving mechanism 85 of the mud pulse generating device 80 based on the signals issued from the signal processing unit 110.

The signal processing unit 110 is defined by a high-frequency amplifier 111 amplifying the digital signals received at the antenna 52, a FM demodulator 112 to demodulate the digital signals, a processing device 113 to translate the demodulated digital signals to the operating speed of the mud pulse generating device 80, and a monitoring circuit 114 to watch the signals inputted to the processing device 113. Incidentally, the high-frequency amplifier 111 and the FM demodulator 112 are referred to as a radiocommunication means in the sonde 4.

The control unit 120 has a signal converter 121 to convert weak signals sent from the processing device 113 to electric information for the mud pulse generating device 80, and a power circuit 122 to supply a necessary electric power to the signal converter 121.

The monitoring circuit 114 of the signal processing unit 110 is a criticalness suspecting means which determines a condition whether the sonde 4 is in safe or not.

Figure 14:
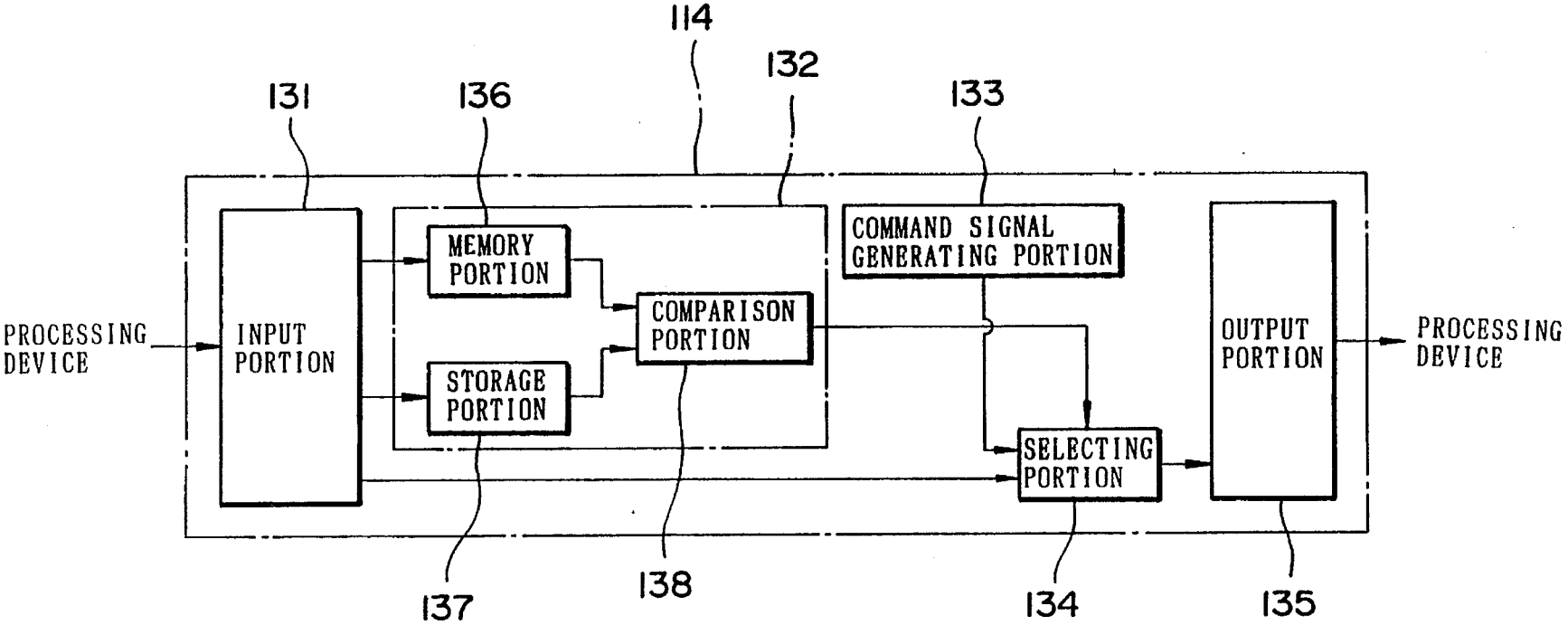
FIG. 14 is a block diagram showing a danger sensing device according to the first embodiment.

The monitoring circuit 114 has, as shown in FIG. 14, an input portion 131 to receive digital signals from the processing device 113, a decision circuit 132 to determine whether the sonde 4 is in a critical condition or not based on the digital signals from the input portion 131, a command signal generating portion 133 to send prepared command signals, a selecting portion 134 to choose either output from the command signal generating portion 133 or from the input portion 131 based on a critical signal issued from the decision circuit 132, and an output portion 135 to return the output of the selecting portion 134 to the processing device 113.

The decision circuit 132 consists of a memory portion 136 to memorize predetermined standard values, a storage portion 137 to temporary keep digital signals from the input portion 131, and a comparison portion 138 to compare the digital signal from the storage portion 137 with the standard value in the memory portion 136.

The comparison portion 138 can analyze a critical state of the sonde when at least one of the digital signals is beyond the predetermined standard value such as temperature, pressure, torque or the like, and thereby inform of the critical state of the sonde to the selecting portion 134. At this time, an under voltage of the generator 41 is also detected to confirm no flow of the mud-flow whereat the floating device 70 can be operated.

The selecting portion 134 outputs a command signal from the command signal generating device 133 to the output portion 135 after receiving the signal meaning the critical state of the sonde. This command is sent to the ground level from the mud pulse generating device 80 to inform the critical state of the sonde and requires to stop feeding of the mud-flow.

The signal processing unit 110 is also provided with a power circuit 115 to supply stable DC current to the high-frequency amplifier 111 and the FM demodulator 112. The power circuit 115 includes a secondary battery for memory backup of the memory portion 136. Incidentally, this power circuit 115 and the power circuit 122 provided for the control unit 120 can receive electric power from the generator 41.

Figure 15:
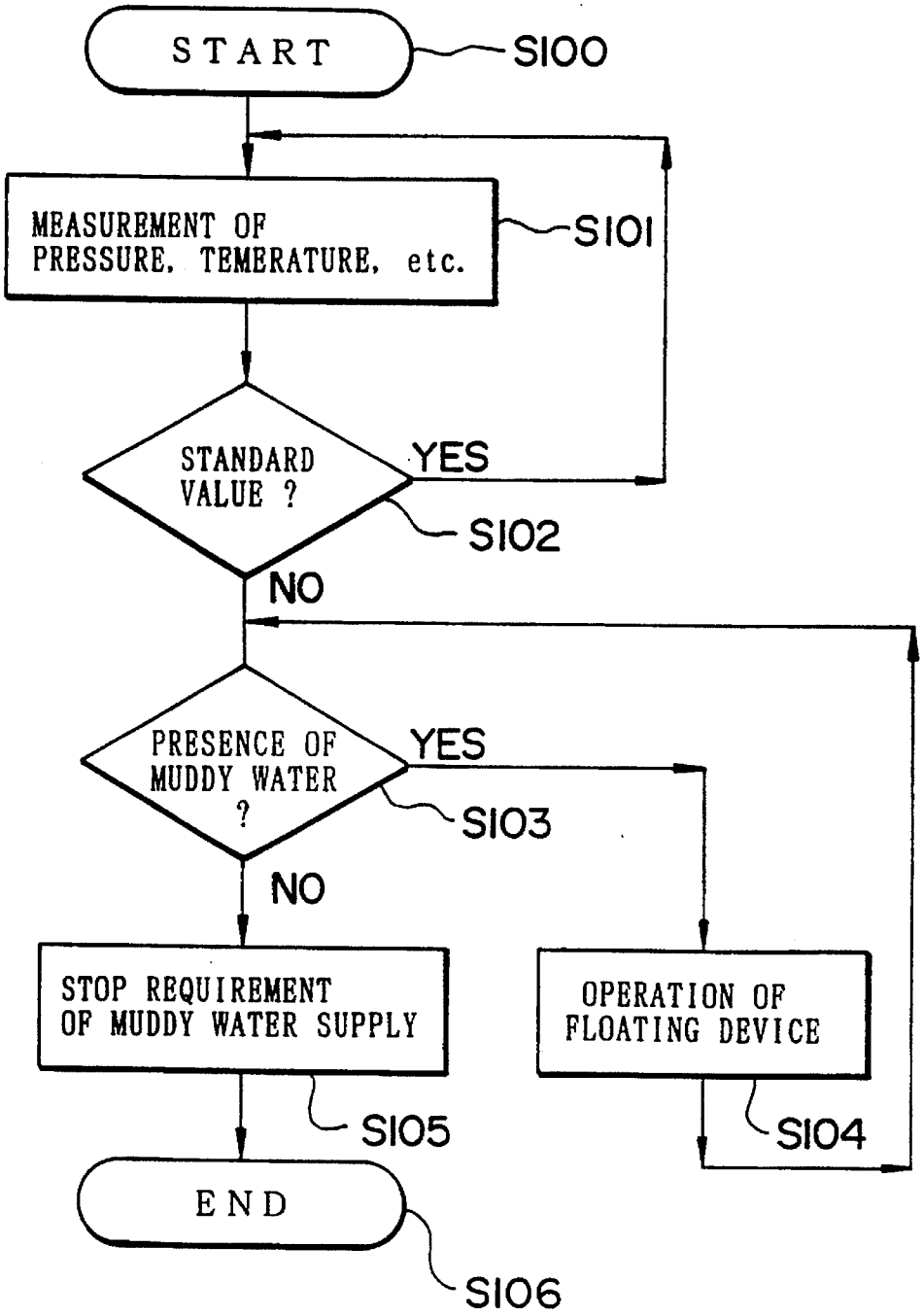
FIG. 15 is a flowchart explaining operations of the first embodiment.

The critical state of the sonde 4 can be prevented by steps shown in FIG. 15 according to this embodiment.

The measuring tool 2 according to this embodiment begins to work at a step S100. At a step S101, necessary data such as temperature, pressure and so on are measured by the temperature sensor 25 and the pressure sensor 26. And at a step S102, it will be evaluated, in the decision circuit 132, whether the measured data belongs to the predetermined standard value or not.

When all of the measured data are in safe, the mentioned steps from the step S101 will be repeated continuously. However, if at least one of the measured data is out of the standard value, the process will advance to a step S103 to sense the mud-flow flow in the drilling pipe 12 by means of sensors connected with the data processing system 16.

When the mud-flow flow is detected, the process further advances to a step S104 and send a command to the ground level so as to stop a supply of the mud-flow. The steps S103 to S104 will be repeated as long as the mud-flow flow will come to an end.

While if there is no mud-flow flow, the process will advance to a next step S105 to operate the floating device 70 whereat the sonde 4 can be evaded from its critical state and the process shown in FIG. 15 will further advance to a last step S106 to end the whole process.

An abnormal vibration in the shaft 1 can be detected by the pressure sensor 26 and the bit torque sensor 22, so that the sonde can avoid another danger due to the abnormal vibration.

The following effects can be expected in the above-mentioned embodiment.

Necessary data at the drilling bit 13 can be transmitted certainly by employing the tool according to this embodiments, as the sensorsub 3 and the sonde 4 respectively have directional loop antennas 51, 52 along with the radiocommunication devices, wherein data transmission from the sensorsub 3 to the sonde 4 is certainly carried out.

The sensorsub 3 and the sonde 4 have the generators 30 and 41 respectively, of which each generates enough electric power by utilizing the mud-flow flow, whereby no electric supply to the tool 2 is necessary to continuously collect information at the down-hole of the shaft 1.

The sonde 4 is forced to be retrieved to the ground by means of the criticalness suspecting means to determine whether the sonde 4 is in safe or not.

The sonde 4 has the chemical reaction type floating device 70 to be floated naturally, which should be better method than by another mechanical type.

The mud-flow smoothly flows enough inside the mud pulse generating device 80, as using the metering valve 80A which can vary a total resistance of the mud-flow flown in the detour passages 82, 83. The durability of valve 80A can be developed and be operated with a small electric power, since the dimensions of the changeover element 84 is rather small.

Figure 16:
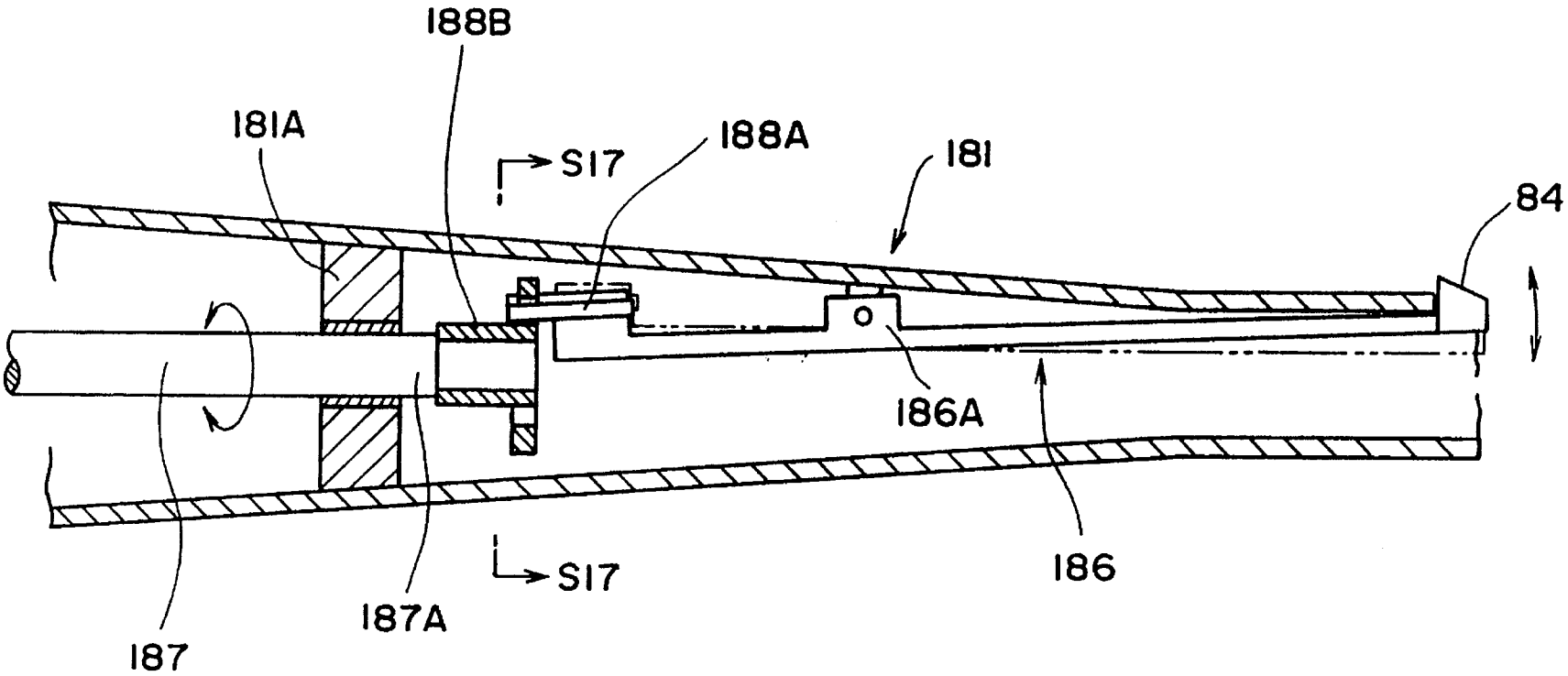
FIG. 16 is a view showing a driving system of the mud-pulse generating device according to the second embodiment as in FIG. 12.
Figure 17:
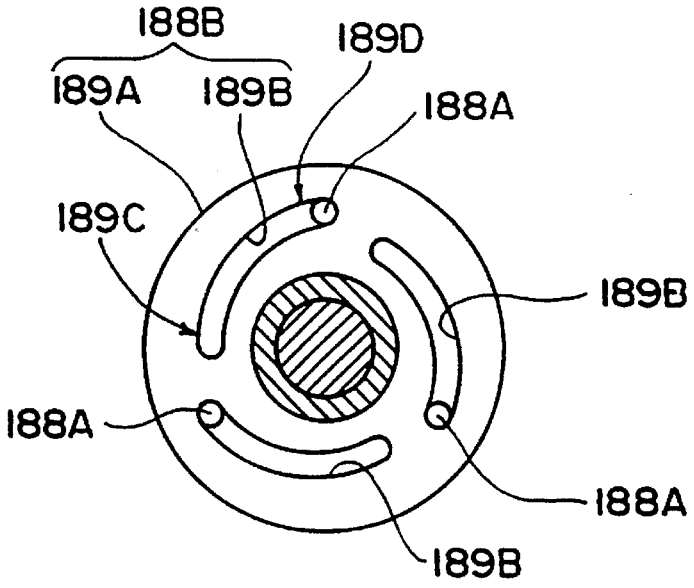
FIG. 17 is an enlarged sectional view taken along the S17—S17 line in FIG. 16.

A second embodiment of another mud pulse generating device according to the present invention is shown in FIG. 16. This embodiment employs a rotational-type driving device 181 serving for the reciprocal-type driving device 81 employed in the metering valve 80A in the first embodiment.

More specifically, the driving device 181 essentially consists of an arm 186 pivotally moving and a round-shaped axle 187 connected each other.

The arm 186 is adapted to swing about an intermediated portion 186A where a projection from the inner surface of the driving device 181 relates. The arm 186 has, at its right end portion in FIG. 16, a changeover element 84 almost same as in the first embodiment and, at its left end portion, a cam-follower pin 188A extending along a rotation axle 187 which is directly connected with a driving source like a motor. Incidentally, the rotation axle 187 is rotatably supported in a bearing 181A fixed to the driving device 181.

The driving source for the rotation axle 187 can positively and negatively rotate by a certain rotation angle of the axle 187.

At the right end portion 187A of the rotation axle 187 in FIG. 16 is provided a cam 188B relating with the cam-follower pin 188A of the arm 186.

The cam 188B is composed of some slots 189B in a rotating plate 189A to receive thereunto the cam-follower pins 188A. Each of the slots 189B, for example from a portion denoted by 189C to that denoted by 189D, is heroically outwardly made about a center of the rotating plate 189A.

When the cam 188B is rotated by the driving source, the changeover element 84 can be reciprocally and radially moved relative to the driving device 181.

This second embodiment can naturally achieve preferable operations and effects as in the first embodiment. As the changeover element 84 is reciprocally and forcibly moved by a combination with the cam-follower pin 188A and the corresponding cam 188B, an inferior operation of the element 84 can be prevented.

Figure 18:
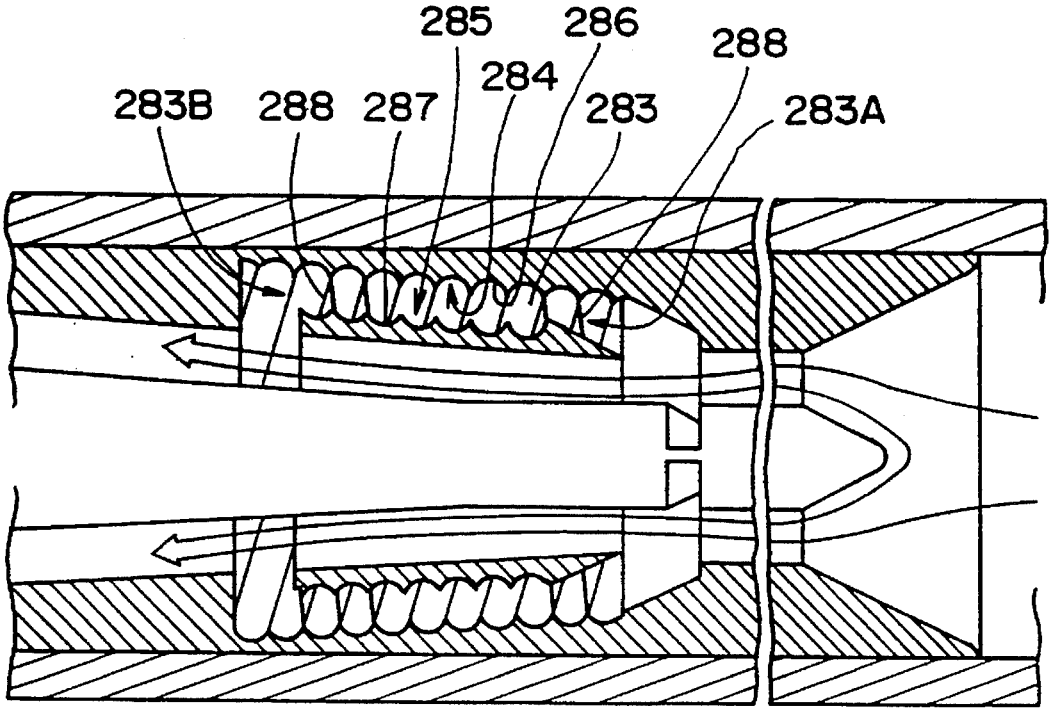
FIG. 18 is a view showing a mud-pulse generating system according to the third embodiment as in FIG. 8.

FIG. 18 shows the third embodiment of the metering valve according to the present invention. This embodiment employs a roundabout passage 283 raising a whirl which serves for the mentioned detour passage 83 provided for the metering valve 80A in the first embodiment.

The roundabout passage 283 has a cylindrical space in the sonde 4 as a whole, of which space is shaped with a female spiral groove 286 on an outer side wall 284 of the sonde 4 and a male spiral groove 287 on an inner side wall 285.

The whirl is soundly raised, guided by plural vanes 288 which are arranged at an inlet port 283A and an outlet port 283B of the roundabout passage 283.

Figure 19:
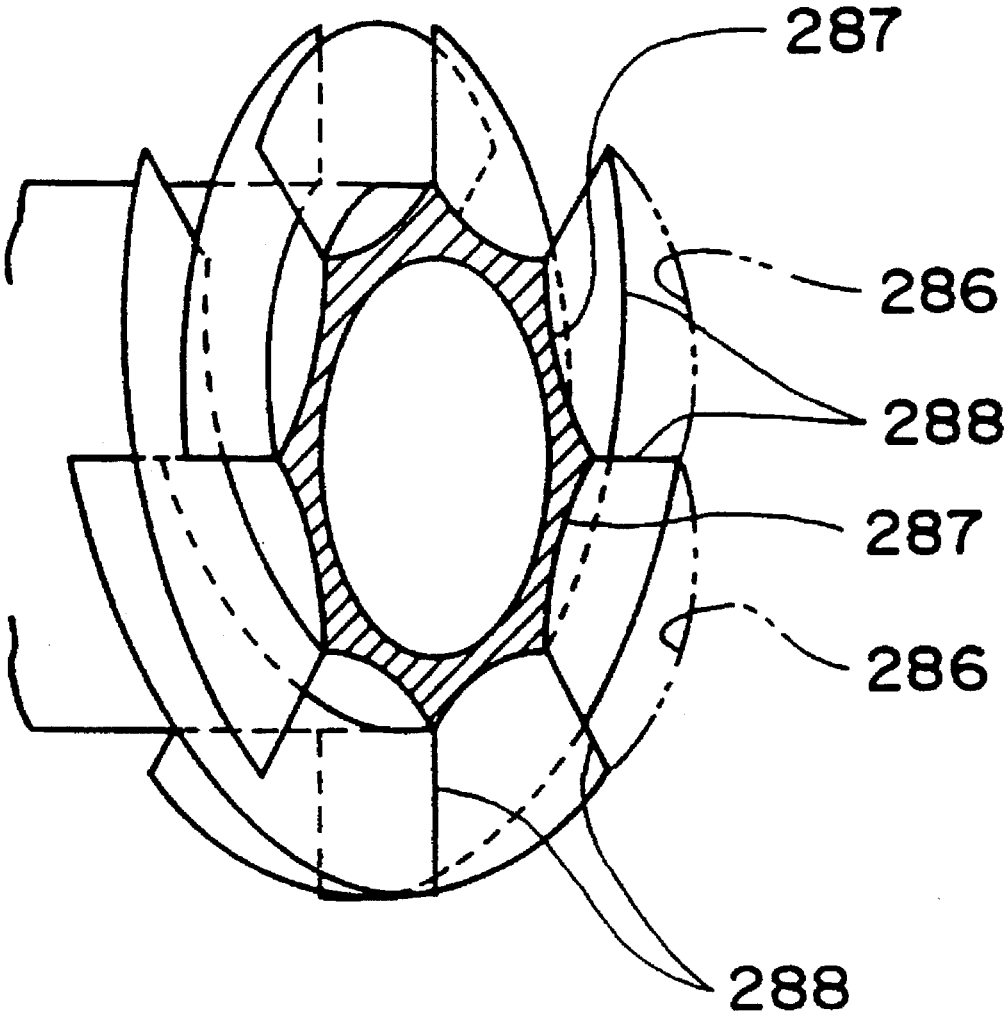
FIG. 19 is an enlarged fragmentary perspective view in the third embodiment.

The used vanes 288 cross over and helically between the respective edges of the spiral lines 286 and 287 as shown in FIG. 19.

This embodiment can also achieve the same operations and effects as in the first and second embodiments. Because of a combination with the pair of the spiral lines 286, 287 and the vanes 288, the roundabout passage 283 can effect the preferable whirl and cause a large resistance in the passage 283.

Figure 20:
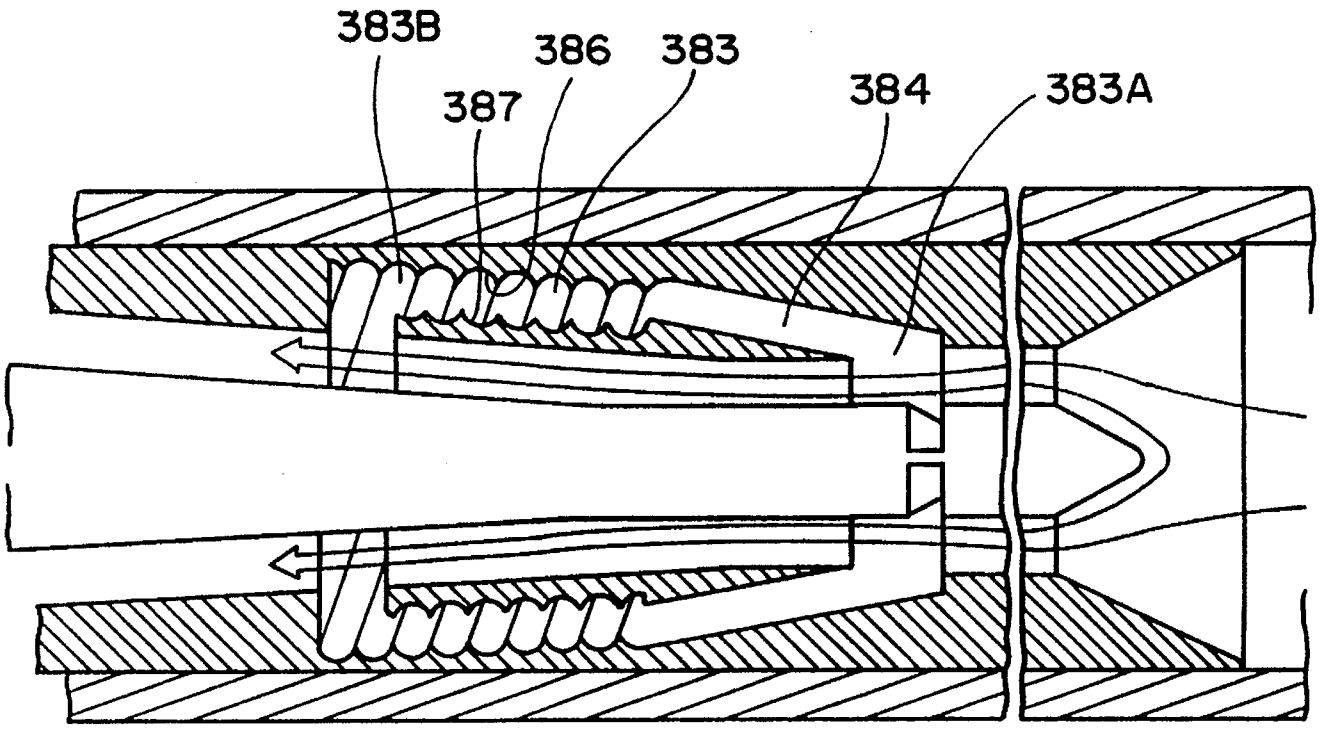
FIG. 20 is a view showing a mud-pulse generating system according to the fourth embodiment as in FIG. 8.

FIG. 20 shows the fourth embodiment of the metering valve according to the present invention. The metering valve in this embodiment employs another roundabout passage 283 differ from that in the third embodiment in a respect that there is no vane in the roundabout passage 283.

Furthermore, at an inlet port 383A of the roundabout passage 383 is provided a straight introductory path 384.

The diameter of the introductory path 384 is gradually spread as the flow direction of the mud-flow, which is effective to raise a preferable whirl by the pair of spiral grooves 386, 387.

This embodiment naturally obtains the equivalent operations and effects as in the first to third embodiments and contributes a productivity of the metering valve because of not vanes.

Figure 21:
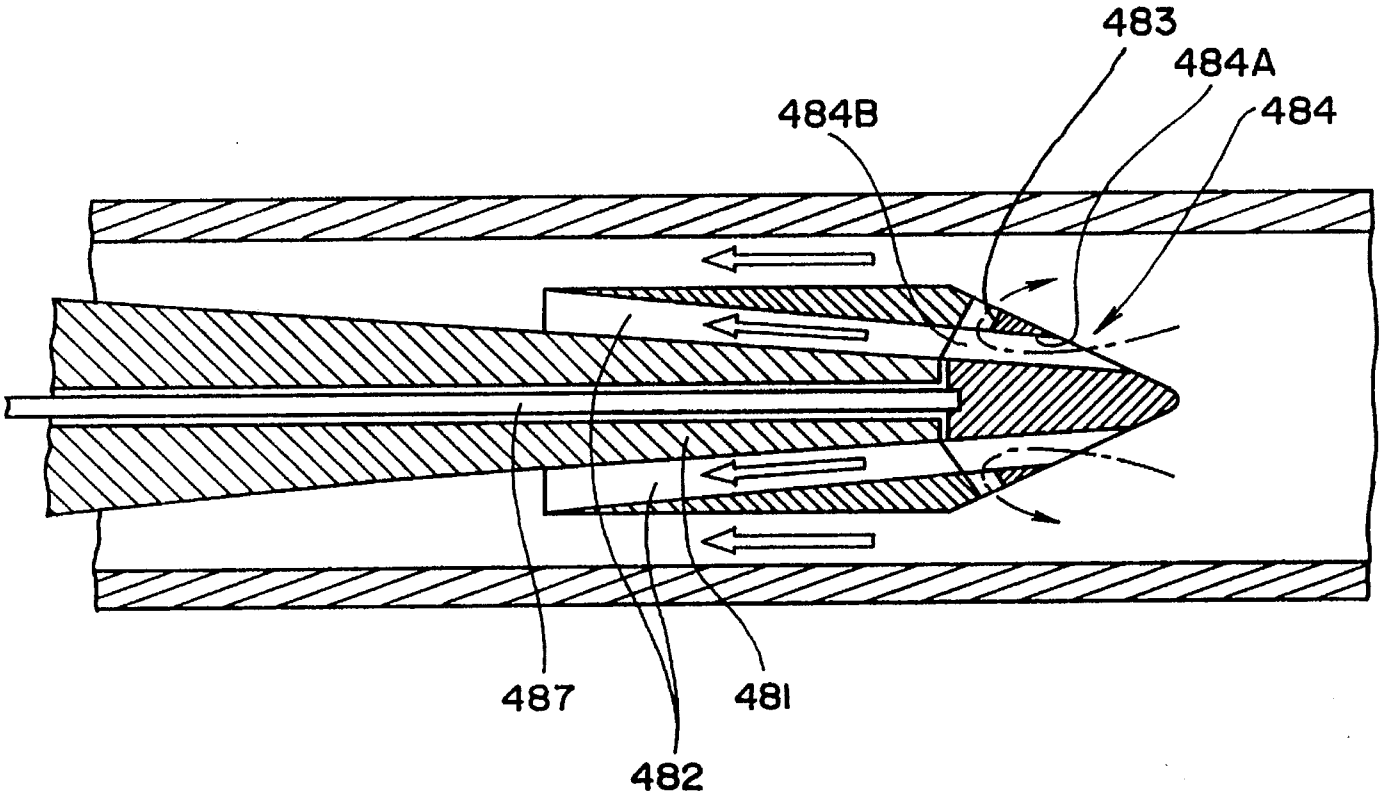
FIG. 21 is a view showing a mud-pulse generating system according to the fifth embodiment as in FIG. 8.

FIG. 21 shows the fifth embodiment of the metering valve according to the present invention. A still another rotatable changeover element 484 is employed in this embodiment to serve for the reciprocate changeover element 84 in the metering valve 80A in the respective first to third embodiments.

Straight passages 482 in this embodiment are arranged around a driving device 481. To an inlet section of the passages 482 is attached the conic changeover element 484.

The changeover element 484 is provided with plural holes 484A at an intervals on a concentric circle so as to open and close the passages 482, being rotated by the shaft 487. The changeover element 484 also has a backflow path 483 near an opening 484B of the hole 484A. The respective paths 483 can effect a main stream of the mud-flow.

Accordingly, when the straight passages 482 are opened, the mud-flow advances into the passages 482 via the holes 484A and the backflow paths 483 with a low flow resistance of the mud-flow.

While, when the straight passages 482 are closed, the introduced mud-flow flow backward via the paths 483 to increase the flow resistance.

This embodiment naturally achieves the same operations and effects as in the mentioned first to fourth embodiments. The mud-flow stream through the straight passages 482 is modified with the rotatable changeover element 484, which can be assembled simply.

Figure 22:
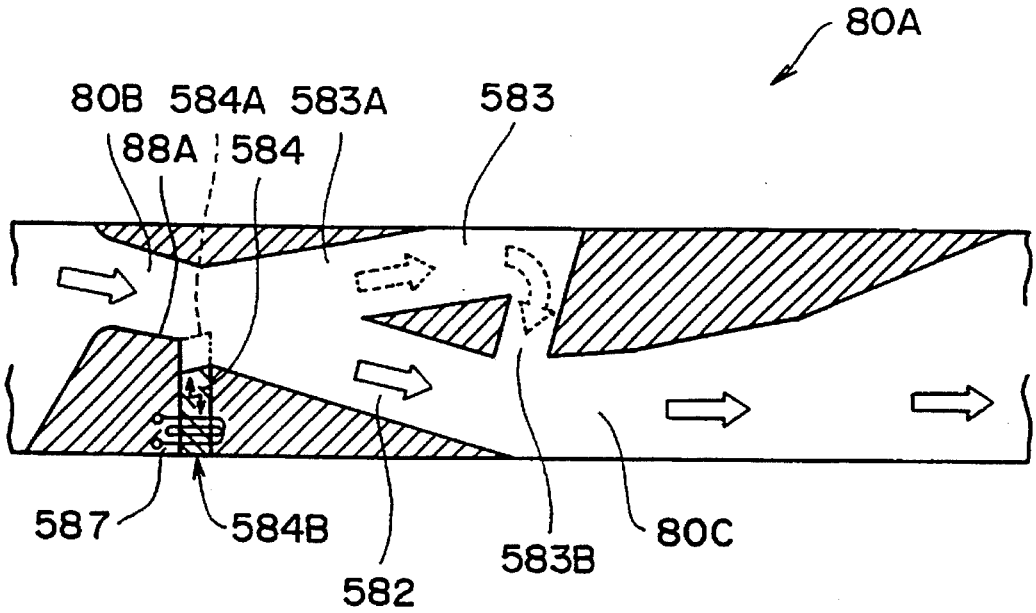
FIG. 22 is a view showing a mud-pulse generating system according to the sixth embodiment as in FIG. 8.

The sixth embodiment of the metering valve according to the present invention is shown in FIG. 22. A metering valve 80A in this embodiment is characterized to have two passages of an open passage 582 and an interference passage 583 between an inlet portion 80B and an outlet portion 80C.

The open passage 582 extends straightly to suppress a flow resistance of the mud-flow.

The interference passage 583 is a branch stream from the open passage 582. Both an inlet opening 583A and an outlet opening 583B of the interference passage 583 faces upstream, so that the mud-flow fed in the opening 583A and out from the opening 583B so as to flow backward to the stream.

In a wall 88A near the inlet portion 80B, an inclination rod 584 is provided, in a reciprocal state, to effect the mudflow stream.

The inclination rod 584 has at the forward end an inclined plane 584A to guide the mud-flow to the inlet opening 583A of the interference passage 583. The reciprocal movement of the inclination rod 584 is controlled by a solenoid valve 587 which is related with a root portion of the rod 584 and is received in the wall 88A.

When the inclination rod 584 is buried in the wall 88A, the fed mud-flow in this metering vale 80A is almost led to the open passage 582 with low flow resistance.

While, the inclination rod 584 is projected from the wall 88A, the inclined plane 584A can effect an intended guide of the mud-flow to the inlet opening 583A. The mud-flow from the outlet opening 583B becomes an upstream flow against the mud-flow flow in the open passage 582. A necessary increase of the flow resistance in this metering valve 80A can be achieved by the mentioned projection of the inclination rod 584.

This embodiment assures to attain following effects.

A desirable amplitude of the pressure pulse wave to send data to the ground level can be obtained by a combination with two passages; the open passage 582 and the interference passage 583 and the movement of the metering valve 80A.

The inclination rod 584 does not need to close the passages to change the direction of the mud-flow whereat the scale and the movement degree of the rod 584 can be minimized. Hence, the inclination rod 584 can be moved rapidly to produce high efficient pressure pulses by means of the solenoid valve 587 with rather low electric power.

The projected portion of the inclination rod 584 is slight, so that a wear problem of the rod because of a high speed flow of the mud-flow will not take place.

Since the inclination rod 584 does not close the passage, particles contained in the mud-flow will not stuck between the rod 584 and the wall.

Figure 23:
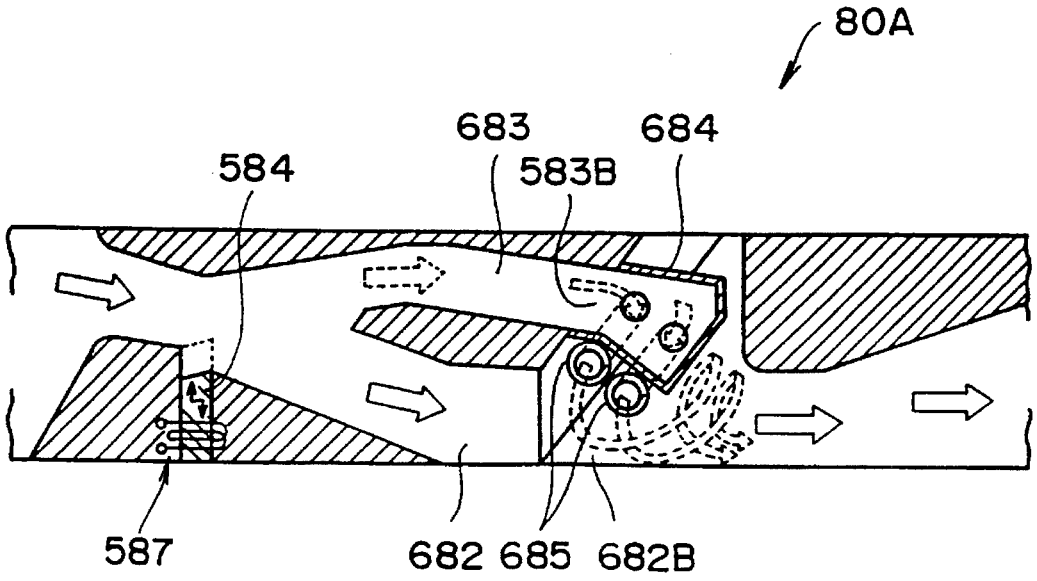
FIG. 23 is a view showing a mud-pulse generating system according to the seventh embodiment as in FIG. 8.

The seventh embodiment of the metering valve according to the present invention is depicted in FIG. 23. This embodiment employs another a whirl flow-resistance type interference passage 683 which differs from the interference passage 583 in the sixth embodiment.

While an outlet side of an open passage 682 is made to form a large and cylindrical chamber 682B.

At an outlet portion 683B of the interference passage 683 is provided a whirl generating device 684 arranged in the chamber 682B.

Figure 24:
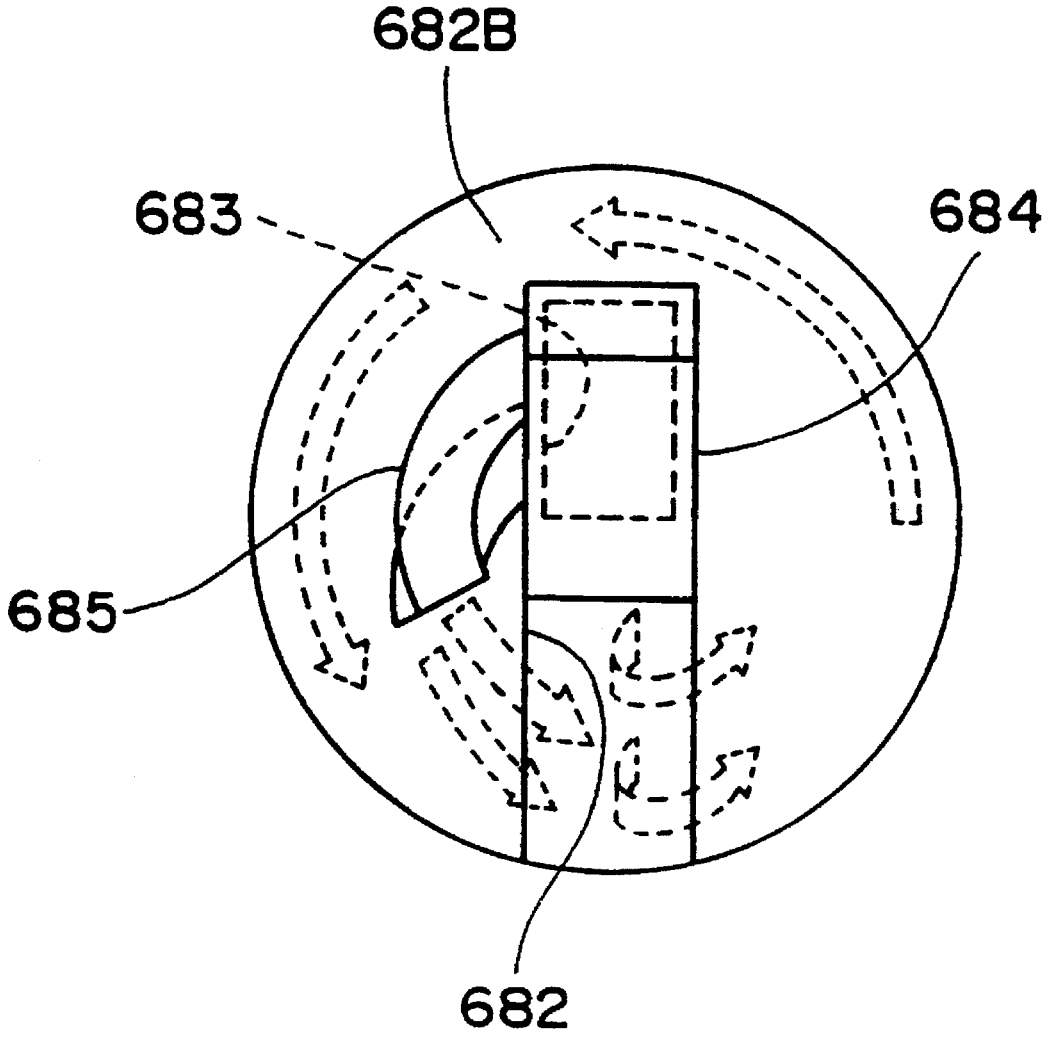
FIG. 24 is an enlarged sectional view according to the seventh embodiment.

The whirl generating device 684 is defined by nozzles 685 to lead the mud-flow in a circular direction of the chamber 682B as shown in FIG. 24. This device 684 assures a large flow resistance in the main stream of the mud-flow in the open passage 682.

The metering device in this embodiment naturally achieves the same effects as that in the mentioned sixth embodiment. Another effect can be gotten in this embodiment, that is, the whirl can produce rather big flow resistance, so that a large amplitude of the pressure pulse will be generated.

Figure 25:
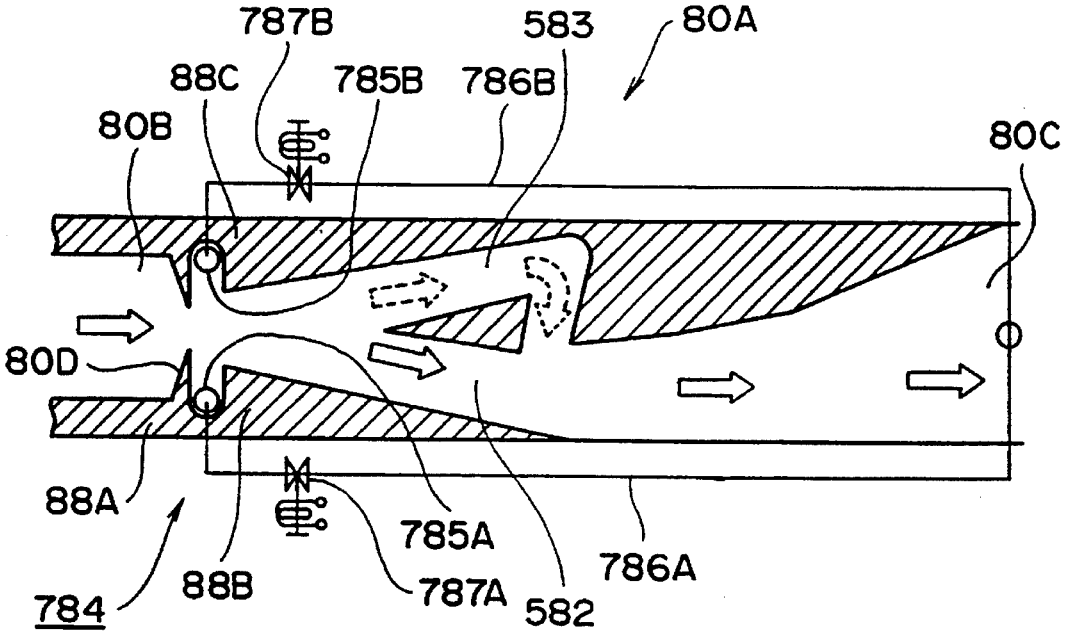
FIG. 25 is a view showing a mud-pulse generating system according to the eighth embodiment.

FIG. 25 shows the eighth embodiment of the metering valve according to the present invention.

At an inlet portion 80B of a metering device 80A in this embodiment is provided an orifice 80D to blow the mud-flow. There are provided behind the orifice 80D control ports 785A and 785B in a wall 88A so as to confront each other.

The control ports 785A, 785B are connected with conduit pipes 786A, 786B respectively to lead the pressure at an outlet portion 80C. Incidentally, the conduit pipes 786A, 786B are respectively provided with solenoid valves 787A, 787B on their ways.

When the one valve 787B is closed and the other valve 787A is opened, all pressure at the outlet portion 80C is led to the control port 785A whereat the mud-flow after the orifice 80D is guided in the open passage 582 along a surface of the wall 88B. While, the valve 787A is closed and the valve 787B is opened, all pressure at the outlet portion 80C is led to the control port 785B whereat the mud-flow after the orifice 80D is flown in the interference passage 583 along the wall 88C.

This embodiment naturally achieve the same effects as those in the already explained sixth and seventh embodiments. As diameters of the conduit pipes 786A and 786B are small, the valves 787A and 787B do not require much electric power.

Figure 26:
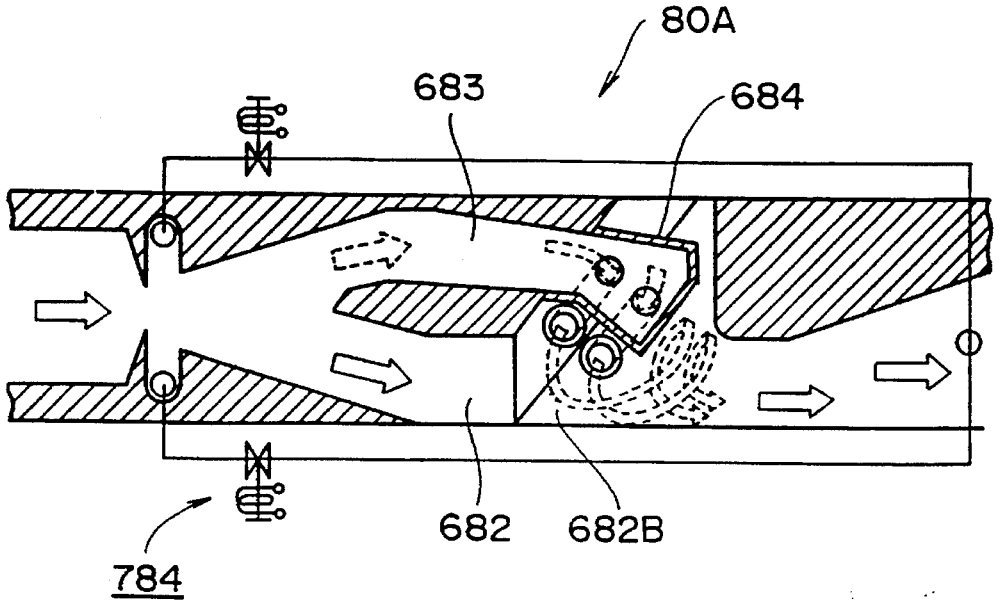
FIG. 26 is a view showing a mud-pulse generating system according to the ninth embodiment.
Figure 27:
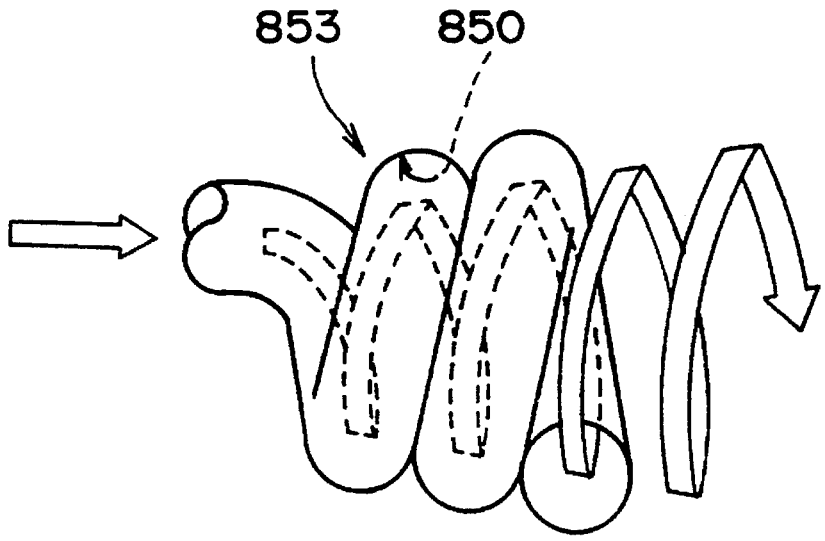
FIG. 27 is a side elevational view showing a modification of the metering valve.
Figure 28:
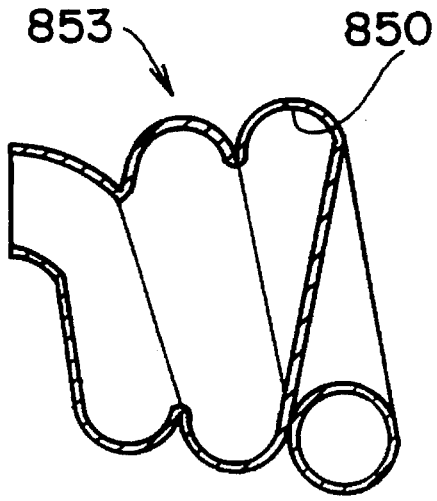
FIG. 28 is a vertical sectional view of FIG. 27.

The ninth embodiment of the metering device according to the present invention is shown in FIG. 26. This metering device has a compromise arrangement with the passages in the eighth embodiment and those in the seventh embodiment.

In the chamber 682B at the outlet side of the open passage 682 is provided the whirl generating device 684 which is connected with the interference passage 683. The whirl generating device 684 enables to generate whirl within the chamber 682B as has been explained in the seventh embodiment.

This embodiment naturally achieve the same effects as those in the mentioned sixth to eighth embodiments and produces large amplitude of the pressure pulse to be sent to the ground level with a low electric power.

Incidentally, the metering valve in the present invention is not only limited to one of the above-mentioned embodiments, but includes following modifications.

The inclination rod may be modified into a vane or flap being able to shift the stream of the mud-flow.

A passage shape of the detour or inference passage already mentioned is naturally modified depending upon designs.

What is claimed is:

1. A measuring tool, operatively connected to a drilling pipe, for collecting down hole information in a shaft, comprising:

a sensor sub having, at a forward portion of the drilling pipe, plural sensors to collect data;

a sonde insertable into said drilling pipe and being movable in an upper and lower direction along a central axis in the drilling pipe, for operative connection to said sensor sub;

a signal sending portion at said sensor sub;

a signal receiving portion at said sonde;

a pair of antenna being respectively provided on said sonde and said sensor sub and wherein respective central axes of each said antenna is positioned on the same axis as the drilling pipe;

said pair of antenna enabling communication from said signal sending portion to said signal receiving portion; wherein said pair of antenna include at least one of a loop antenna and a helical antenna; and wherein said sonde includes a floating device for lifting the sonde through said drilling pipe responsive to conditions in said down hole.

2. The measuring tool for collecting down hole information according to claim 1, wherein at least one of said sensor sub and said sonde has a turbine generator.

3. The measuring tool for collecting down hole information according to claim 1, wherein said sensor sub has therein a rotatable turbine and wherein said sonde has a generator which is equipped with a propeller shaft interconnecting with the turbine in said sensor sub.

4. The measuring tool for collecting down hole information according to claim 1, wherein said floating device includes a gas generator for chemically generating a gas supplied to a chamber within said sonde, whereby said sonde is lifted through said drilling pipe by means of buoyancy generated by the gas filled chamber.

5. The measuring tool for collecting down hole information according to claim 4, wherein the chemical reaction in the gas generator is effected by a sodium bicarbonate and an acid.

6. The measuring tool for collecting down hole information according to claim 1, wherein said sonde includes a criticalness suspecting means for comparing a prepared standard value with a measured value of the sensors in said sensor sub to issue a signal when the measured value is beyond the standard value which indicates whether the sonde is in a critical condition.

7. The measuring tool for collecting down hole information according to claim 1, wherein said sonde is integrated with a centraliser, so that the central axis of said sonde is axially aligned with the central axis of the drilling pipe.

8. The measuring tool for collecting down hole information according to claim 7, wherein the centraliser includes plural arch-shaped blade springs along said sonde.

* * * * *